US007178534B2

(12) United States Patent
Garman et al.

(10) Patent No.: US 7,178,534 B2
(45) Date of Patent: Feb. 20, 2007

(54) HIGH PRESSURE TUBE CLEANING APPARATUS

(75) Inventors: Daniel T. Garman, Eveleth, MN (US); Dennis Swanson, St. Francis, MN (US); Peter Coldagelli, Eveleth, MN (US); Kevin Celley, Biwabik, MN (US)

(73) Assignee: Aquadynamics, Inc., Sulfur, LA (US)

( * ) Notice: Subject to any disclaimer, the term of this patent is extended or adjusted under 35 U.S.C. 154(b) by 18 days.

(21) Appl. No.: 10/673,748

(22) Filed: Sep. 29, 2003

(65) Prior Publication Data

US 2004/0069331 A1 Apr. 15, 2004

Related U.S. Application Data

(63) Continuation-in-part of application No. 09/811,064, filed on Mar. 16, 2001, now Pat. No. 6,626,195.

(51) Int. Cl.
*B08B 9/00* (2006.01)

(52) U.S. Cl. ..... 134/167 C; 134/168 C; 134/169 C; 15/104.33; 15/104.095

(58) Field of Classification Search ..... 134/166 R, 134/167 R, 167 C, 166 C, 168 C, 168 R, 134/172, 180, 22.1, 22.11, 22.12, 22.18, 24, 134/169 C; 137/355.16; 15/104.33, 104.095
See application file for complete search history.

(56) References Cited

U.S. PATENT DOCUMENTS

| | | | | |
|---|---|---|---|---|
| 2,111,527 A | * | 3/1938 | Blanc | 15/104.33 |
| 2,199,651 A | * | 5/1940 | Quick | 15/104.33 |
| 2,267,493 A | * | 12/1941 | Clotz | 15/104.33 |
| 2,953,799 A | * | 9/1960 | Arnold | 15/104.33 |
| 3,095,592 A | * | 7/1963 | Hunt | 15/104.33 |
| 3,449,783 A | | 6/1969 | Kirschke | |
| 3,748,050 A | | 7/1973 | Poppitz | |
| 3,987,963 A | * | 10/1976 | Pacht | 239/124 |

(Continued)

FOREIGN PATENT DOCUMENTS

JP 402031878 A 2/1990

OTHER PUBLICATIONS

Gardner Denver Water Jetting Systems, Inc., Operator's Manual, "10,000 PSI-'V' Drum (Rotary Line Cleaner)", Oct. 20, 2000, 16 pages.*

(Continued)

*Primary Examiner*—Michael Barr
*Assistant Examiner*—Sarah E Husband
(74) *Attorney, Agent, or Firm*—D L Tschida

(57) ABSTRACT

An assembly for rotating and axially directing a high pressure spray hose and spray head to clean residue from the bores of thermal transfer tubes. Modular subassemblies are concentrically aligned and mounted to rotate in synchrony and direct a high-pressure water hose and spray head. An air controlled operator control gun directs spray pressure and hose movement. A hose drive assembly controls hose rotation and axial hose movement via biased pinch wheels that abut the hose. An eccentric linkage and spring tensioners coupled to the pinch wheels release and re-engage the wheels to the hose at a preset pressure. A layering arm stacks the hose in uniform layers at a hose reel. Rotational sensors and/or a pneumatic booster and a disk brake assembly facilitate hose collection and release without kinking or spillage.

35 Claims, 16 Drawing Sheets

U.S. PATENT DOCUMENTS

| | | | | | |
|---|---|---|---|---|---|
| 4,225,362 | A | | 9/1980 | Sentell | |
| 4,367,790 | A | | 1/1983 | Draeger | |
| 4,422,882 | A | | 12/1983 | Nelson | |
| 4,580,306 | A | * | 4/1986 | Irwin | 15/104.33 |
| 4,687,011 | A | | 8/1987 | Masaru | |
| 5,022,463 | A | * | 6/1991 | Boisture | 165/95 |
| 5,067,558 | A | | 11/1991 | Boisture | |
| 5,113,885 | A | | 5/1992 | Ramsey | |
| 5,193,242 | A | * | 3/1993 | Irwin | 15/104.33 |
| 5,320,072 | A | | 6/1994 | Theiss | |
| 5,323,797 | A | | 6/1994 | Rankin | |
| 5,560,323 | A | | 10/1996 | Billings | |
| 5,579,726 | A | | 12/1996 | Finucane | |
| 5,605,117 | A | | 2/1997 | Moskal | |
| 5,862,561 | A | * | 1/1999 | Irwin | 15/104.33 |
| 6,206,016 | B1 | | 3/2001 | MacNeil | |
| 6,418,947 | B1 | | 7/2002 | MacNeil | |

OTHER PUBLICATIONS

Jetting Systems, Inc.—Rotary Flex Lancer, Advertisement.*
Gardner Denver Operating manual (included with previous office action).*

* cited by examiner

HIGH PRESSURE TUBE CLEANING APPARATUS

RELATED U.S. APPLICATION DATA

This is a continuation-in-part application of U.S. Ser. No. 09/811,064, filed Mar. 16, 2001 now U.S. Pat. No. 6,626, 195.

BACKGROUND OF THE INVENTION

The present invention relates to cleaning equipment for tubes and piping and, in particular, to high-pressure water spray systems for cleaning the bores of tubes mounted in a variety of equipment, such as heat exchangers, falling pressure evaporators and the like.

Industrial piping systems of all types frequently require cleaning. A problem especially common to heat exchangers and evaporators is that over time the bore and exterior walls of the heat exchange tubes develop corrosion, scale and other undesired residue. The buildup of residue decreases and/or generally adversely effects the heat transfer efficiencies. Restriction of the bore is especially critical. Operating costs for fuel, in turn, increase.

Periodic maintenance is thus required to clean the tubes, on the order of once or twice a year. Frequently the equipment and/or large sections of an operating plant must be taken off-line during maintenance. Such maintenance can be performed by plant personnel or outside contractors who are specially trained and use special purpose equipment to perform such tasks. It is desirable that any down time be minimized. The task is typically performed manually and is therefore costly and time consuming, especially for large heating and cooling plants.

A variety of techniques and types of equipment have been developed to clean the interior and exterior surfaces of pipes and particularly heat transfer tubes. Soot blowing and chemical shocking are two techniques. Another technique is to individually direct equipment into each tube to mechanically dislodge the residue from the tube walls. Some of the latter equipment uses rigid lances that either rotate and/or have rotating blades. U.S. Pat. No. 5,579,726 discloses a lance-based assembly that directs streams of high-pressure water to effect the cleaning. The latter system supports a rotating and axially directed lance from a frame that can be aligned to each tube.

High-pressure spray systems are also known that direct streams of water from a spray hose into each tube. Jetting Systems & Accessories, Inc. sells one such system under the brand name "FLEX LANCER". Another system is sold by Gardner Denver Water Jetting Systems, Inc., Houston, Tex. under the name "V" Drum Rotary Line Cleaner. The latter system provides a high-pressure hose and spray nozzle that are rotated and axially directed under power. Hose movement is directed with a hand-operated air controller and a pinch roller assembly that controls axial hose movement. Rotational movement is controlled via a separate motor. The hose is collected and dispensed from a rotating V-shaped spool or drum. Although offering advantages, the efficiency of the latter system is severely restricted by vibrations that occur due to unbalanced conditions that can occur at the equipment during typical use. Extreme vibrations have particularly been experienced at speeds approaching 60 rpm, which severely limits the utility of the equipment.

The present invention was developed to provide a more efficient high-pressure spray system. The assembly provides a hose mounted spray head or nozzle that can be operated at rotational speeds in the range of 60 rpm to 850 rpm. Axial speeds in the range of 1 foot per minute to 80 feet per minute are also possible. At a nominal rotary speed of 300 rpm and an axial speed of 60 feet per minute, the assembly is able to clean a typical 36-foot tube in one-fourth the time as the foregoing equipment.

The assembly is constructed to provide optimal balance along the entire drive train. The assembly can also clean the exterior surface of the spray hose as it is dispensed and collected from a driven spool or reel assembly. The reel assembly stacks the hosing in a tapered coil that is balanced to the longitudinal drive axis of the hose drive train. The hub of the reel assembly can be adjusted to accommodate different lengths and diameters of hose. The reel hub can be open or covered to prevent the buildup of debris within the reel and/or prevent the hose from being ejected from openings in the interior and exterior peripheral surfaces.

An improved, air powered modular cleaning assembly is also disclosed. The hose drive assembly and hose reel assembly are modularly configured and clamped to a framework. An extension sheath and improved operator control gun separately latch to each other and an air swivel. Pneumatic control is directed via operator-actuated valves, contiguous control lines, hose and pinch wheel drive motors, a hose reel brake, and associated volume booster and timer controls. The hose drive assembly is driven and the hose reel assembly follows.

SUMMARY OF THE INVENTION

It is accordingly a primary object of the invention to provide a high-pressure tube cleaning assembly wherein a spray hose and spray nozzle can be directed at high rotational and axial rates by the assembly as the nozzle is directed through each tube being cleaned.

It is a further object of the invention to provide an assembly that includes a rotationally driven hose reel that arranges the spray hose in a fashion that avoids unbalancing the equipment relative to a longitudinal, rotational drive axis.

It is a further object of the invention to provide a hose reel having a conically tapered, hose collection hub mounted adjacent to a concentric outer cage and on which hub the hose is stacked in coils concentrically aligned to the longitudinal drive axis.

It is a further object of the invention to provide a hose cleaning assembly that cleans the hose as it is dispensed and collected.

It is a further object of the invention to provide a rotary mounted, air-controlled hose drive assembly having four polyurethane pinch-type drive wheels that axially direct the hose along the assembly's longitudinal drive axis and that is rotationally balanced relative to a hose reel.

It is a further object of the invention to provide a hose drive assembly wherein the drive wheels include surfaces or grooves that align and maintain hose movement along the assembly's longitudinal drive axis and/or wherein the durometer of the drive wheels is selected to prevent slippage.

It is a further object of the invention to provide a hose drive assembly wherein the tension of the drive wheels against the hose is established with spring biased tensioners and/or wherein an eccentric cam linkage directs the wheels to grip and release the hose.

It is a further object of the invention to provide a pinch wheel assembly that includes a two-stage, linked upper and lower, eccentric cam linkages that collectively direct two of the wheels to pivot and engage and release the hose at preset tensions relative to two stationary wheels.

It is a further object of the invention to provide a drive axle at the hose reel that is coupled to the hose drive assembly and from which axle a layering arm extends that aligns the hose relative to an adjustable hub at the hose reel.

It is a further object of the invention to provide a cleaning assembly wherein only the hose drive assembly and layering arm is rotated via an air driven motor and belt linkage and/or wherein the hose reel is supported to follow hose movement.

It is a further object of the invention to provide a belt tensioner linkage at the hose drive assembly.

It is a further object of the invention to provide a brake and attendant sensors and controls to control hose reel movement in relation to cleaning and emergency operations to prevent hose kinking and spillage.

It is a further object of the invention to provide a hose collection hub wherein the diameter and taper of the hose collection hub can be adjusted relative to the outer cage and center drive axle.

It is a further object of the invention to provide a hose reel having substantially imperforate interior and/or exterior walls that reduce weight, minimize debris accumulation and prevent hose escape.

It is a further object of the invention to provide control air passages at the hose drive/air swivel assembly and/or latched bearing supports at the hose drive/air swivel assembly and hose reel to facilitate repair and replacement.

It is a further object of the invention to provide an operator control gun with several hand controlled switches/valves to direct air through the pneumatic control lines.

It is a further object of the invention to provide an operator control gun with a pair of handgrips and wherein at least one of which can be selectively adjustabed to permit horizontal and vertical cleaning operations.

It is a further object of the invention to provide latched, multi-ported couplings at the air swivel to the operator control gun and/or extension sheath and attendant pneumatic control lines.

It is a further object of the invention to provide hand-operated control valves in one or more of the pneumatic control lines to selectively regulate delivered air.

It is a further object of the invention to provide a selectively adjustable belt tensioner at the hose spool drive motor and/or others of the motors.

The foregoing objects, advantages and distinctions of the invention, among others, are obtained in the one disclosed tube cleaning assembly that has been particularly adapted for use in cleaning heat exchangers and falling tube evaporators. The invention can be adapted to other applications wherein the tool head is coupled to a high-speed, rotationally and axially directed cleaning media supply conduit and/or control lines.

The subject tube cleaning assembly provides a mobile framework that attaches to on-site air and water supplies. The assembly includes a number of subassemblies that are concentrically and axially aligned along a longitudinal drive axis to direct a high-pressure water hose and a multi-orifice, spray head or nozzle via a hand-held, operator directed gun. The operator gun is selectively fitted to each tube and the spray head is axially directed to clean each tube. The hose delivery subassemblies are mounted to rotate in controlled synchrony at a number of pillow block bearings.

At a fore end, the hose and orifice containing spray head are directed through a hose cleaning subassembly that washes the hose with a low-pressure spray. The hose is rotated and axially directed to and fro with an air-controlled hose drive assembly. Hand-operated valves at the operator control gun direct control air between an air swivel and several drive motors and control devices. Drive power is applied to a pair of driven gears and chains to follower gears attached to four polyurethane pinch wheels that abut the hose. Spring tensioners control the wheel-to-hose pressure or tension and are able to axially direct the hose at speeds of 1 to 80 feet per minute.

The hose drive is coupled to a hose collection reel via a motor driven reel axle. A layering arm extends from the axle and directs the hose onto an adjustable hub at the reel. The hose is preferably stacked in a single layer. High-pressure water in the range of 3,000 psi to 50,000 psi is supplied to the hose via a swivel coupling at the reel axle.

The diameter of the hub at the hose reel can be adjusted relative to an outer cage.

The layering arm and hub cooperate to stack the hose in concentric layers relative to the longitudinal drive axis of the assembly to assure a balanced loading. The reel, axial hose drive and hose cleaner assemblies can be operated at rotational speeds in the range of 60 rpm to 650 rpm. The assembly is thereby able to clean tubes from ½ to 6-inch diameters at rates of 1 to 80 feet per minute.

An improved cleaning assembly is also disclosed and wherein modular hose drive and hose reel assemblies are latched to collared bearing surfaces affixed to the framework. Air operated motors and belt drive linkages drive the hose drive assembly and hose and from which the layering arm extends. Hose movement through the layering arm determines the movement of the hose reel. An air operated disk brake and caliper assembly control hose reel movement to prevent hose kinking and spillage and facilitate emergency stopping.

Upper and lower air drive motors at the hose drive assembly control pinch wheel rotation and axial hose movement. Spring tensioners establish wheel-to-hose tension. A lever handle operates a two-stage, upper and lower, eccentric cam linkage assembly to collectively direct the hose drive wheels to rotate and engage and release the hose at preset tensions.

An operator control gun and accessory extension sheath protect and direct the hose into the tubes and contain control air conduits. Multi-ported clamp couplers align and securely retain the control lines to the air swivel and one another. Operator manipulated air valves at a pair of position adjustable handgrips control hose movement and emergency shutdown.

Still other objects, advantages, distinctions and constructions of the invention will become more apparent from the following description with respect to the appended drawings. Similar components and assemblies are referred to in the various drawings with similar alphanumeric reference characters. Various features of the invention may also be configured with other features in different combinations. The description should therefore not be literally construed in limitation of the invention. Rather, the invention should be interpreted within the broad scope of the further appended claims.

Like assemblies, subassemblies and components at the drawings are referenced with like alphanumeric reference callouts.

DESCRIPTION OF THE PREFERRED EMBODIMENT

Figure 1:
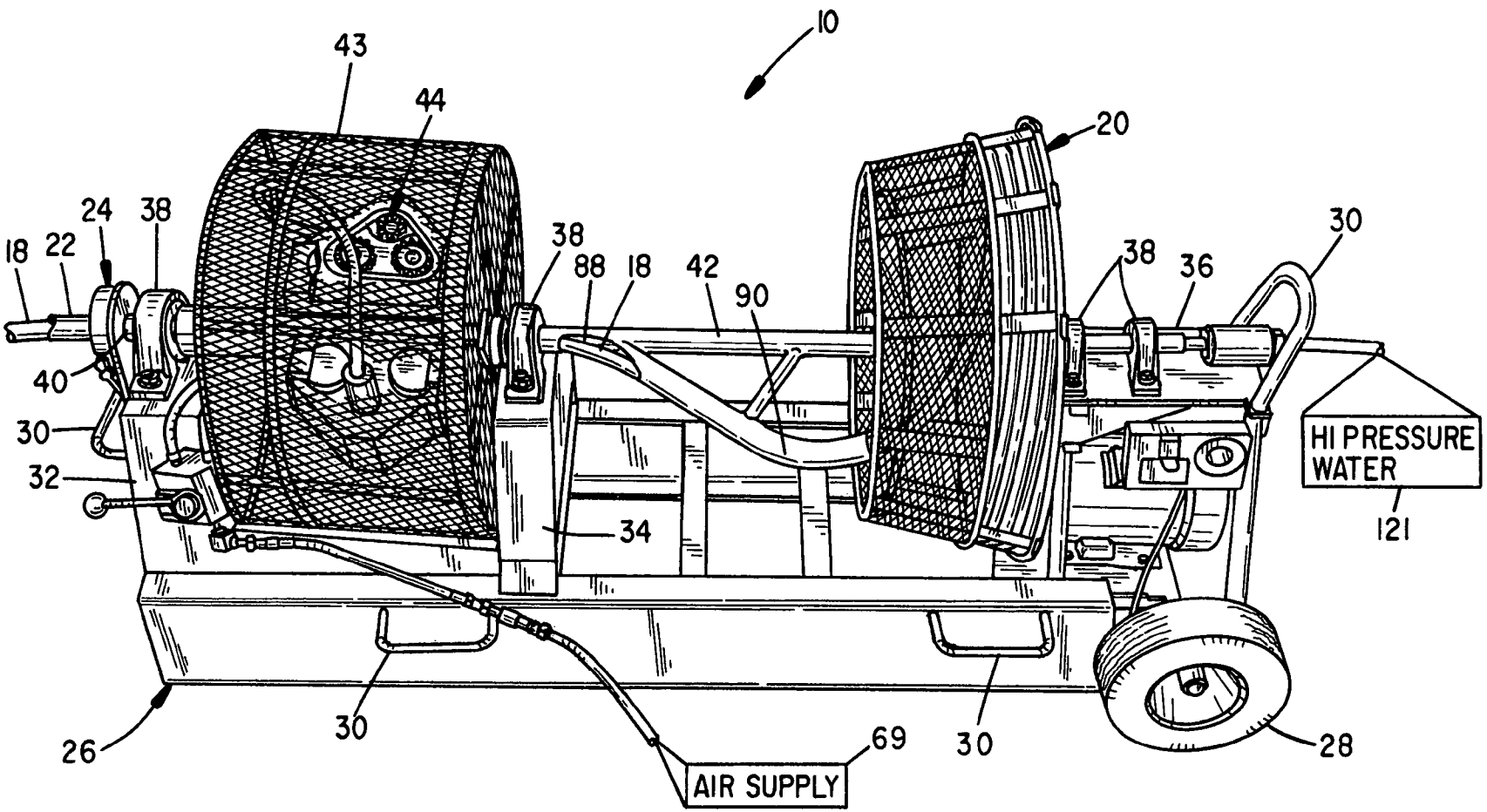
FIG. 1 is a perspective drawing shown in partial cutaway and exposing the various subassemblies of the high-pressure spray cleaning equipment of the invention.

Referring to FIG. 1 a perspective drawing is shown to the portable, high-pressure spray cleaning assembly 10 of the invention. The assembly 10 finds particular application for on-site cleaning of heat transfer tubes in commercial and industrial heat exchangers. A spray head 12 having a desired number of orifices 14, reference FIG. 2, directs a number of high-pressure (e.g. 200 to 50,000 psi) streams of water against the bore walls of a heat transfer tube or pipe 16 to dislodge and wash scale and residue from the tube walls 16. The spray head 12 is rotated and axially extended and retracted from the tube 16 to most advantageously direct the spray streams from the orifices 14. A suitable length of hose 18 is secured to the spray head 12 and is deployed and stored at a hose spool or collection reel assembly 20. The hose 18 is constructed to withstand the normal anticipated working conditions and pressures. The hose 18 is typically constructed of several layers of water impermeable material in numerous wound wrappings and may contain wraps or bands of wire, KEVLAR and the like. The diameter of the hose 18 can be adjusted as desired (e.g. ⅛ to 1 inch) depending upon the application, diameter of tube 18 and desired working pressures.

The hose 18 is contained in a length of a flexible, tubular cover piece 22 that is secured to a hose washing assembly 24. The hose 18 is free to slide and rotate within the cover piece 22. The cover piece 22 particularly protects the hose 18 as an operator directs the assembly and hose 18 about the work site and as the hose 18 is manipulated by the operator and fitted to each tube 16 being cleaned.

A support frame 26 provides a number of wheels 28 and handles 30 that make the assembly 10 portable. Several stanchions 32, 34 and 36 rise from the frame 26 to support a number of pillow block bearings 38. A forward, hollow stub axle 40 and a partially hollow drive axle 42 are contained by the bearings 38 and permit rotation of a coupled axial hose drive assembly 44 and the hose reel 20. The horizontal spacing between and vertical offset of the stanchions 32–36 can be adjusted depending upon the size and length of hose 18 that is being deployed.

Figure 2:
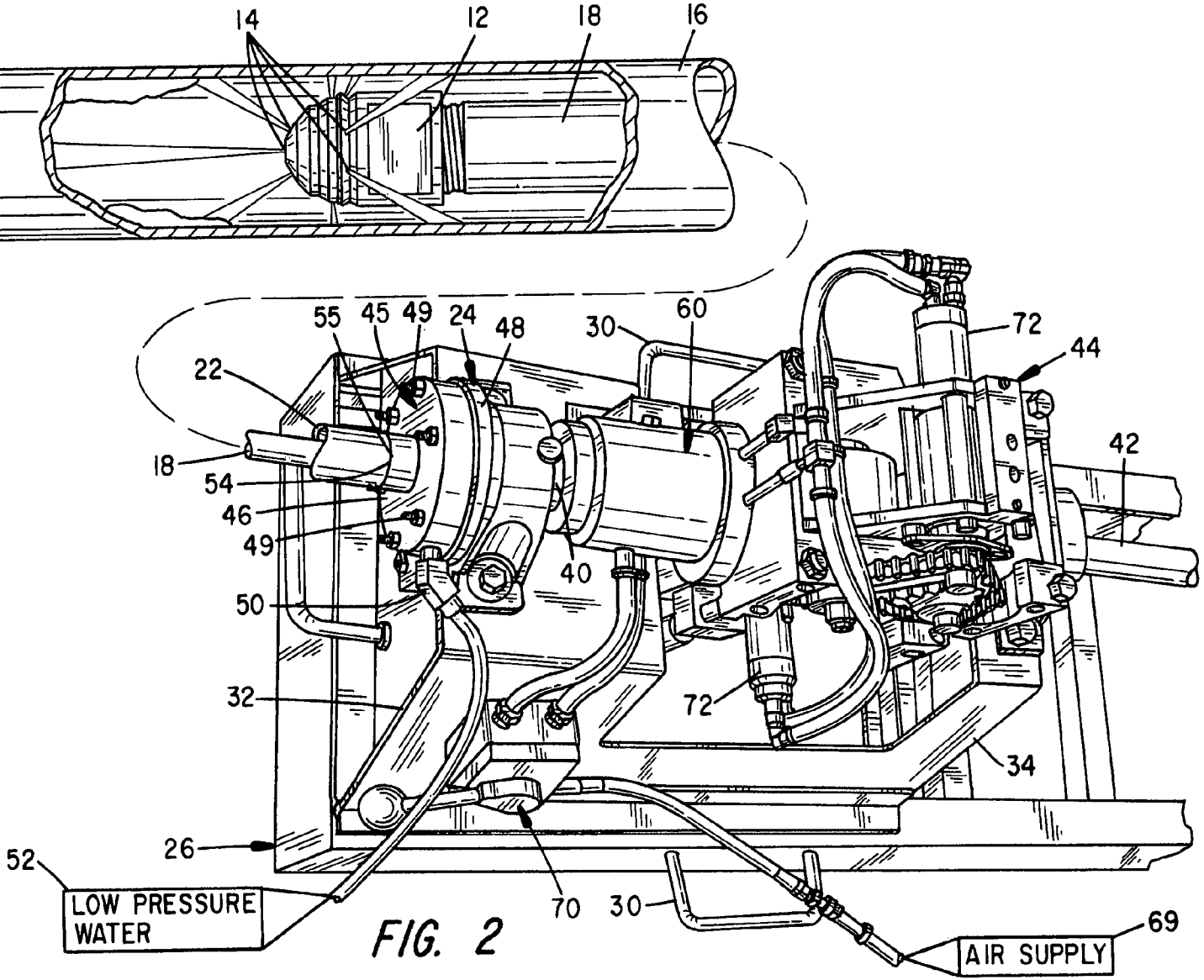
FIG. 2 is a detailed perspective view to the hose cleaner and air-driven hose drive and wherein the spray head is also shown in cutaway in a typical heat exchanger tube.

With attention to FIG. 2, the hose cleaning assembly 24 extends forward of the stanchion 32 from the stub axle 40. The hose cleaning assembly 24 essentially comprises a manifold 45 having bolted cylindrical sections head and backing pieces 46 and 48 that directs several low-pressure streams of water onto the outer walls of the hose 18. A number of flow channels (not shown) are formed into head and backing pieces 46 and 48 that are secured with several fasteners 49. A fitting 50 couples a water supply line 52 to the manifold 45. The water is directed from a central bore 54 through which the hose 18 passes. One or more brushes 55 can be secured and concentrically aligned to the headpiece 46 and the hose 18 to scrub debris during hose cleaning.

The hose 18 is directed axially through the cleaning assembly 24 by the hose transport or drive assembly 44. The hose drive assembly 44 is mounted to rotate between the stanchions 32 and 34 and is covered by a safety cage 43. The hose reel 20 is mounted to rotate between the stanchions 34 and 36. Each of the assemblies 20, 24 and 44 are concentrically aligned to the center longitudinal drive axis of the assembly 10 and relative to which the hose 18 is particularly coaxially and concentrically aligned. Hose movement is thus balanced to the drive axis and the enhanced operating speeds are possible.

Figure 3:
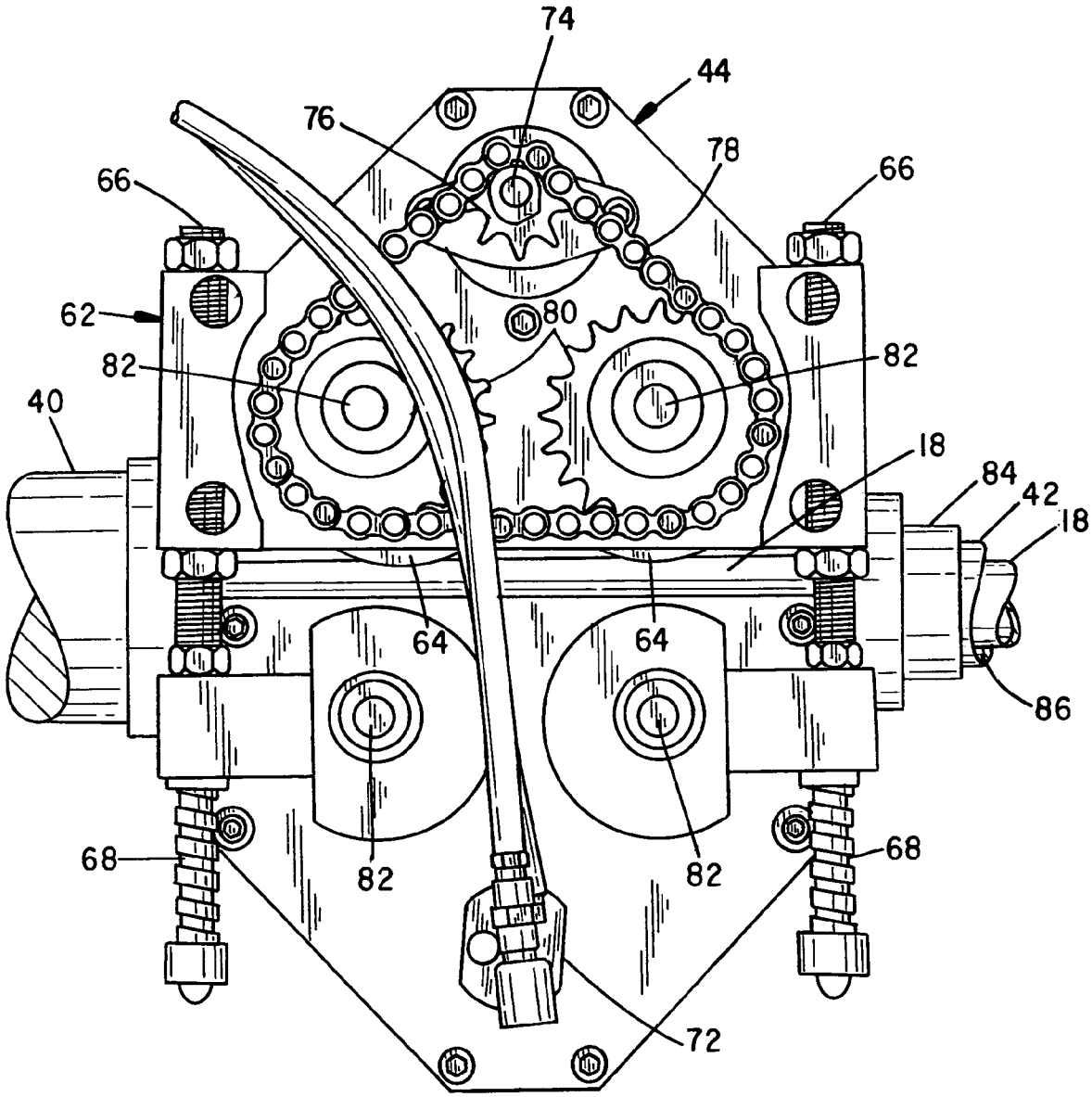
FIG. 3 is an enlarged plan view of the hose drive assembly

With attention to FIGS. 2 and 3, an air swivel 60 is secured to the forward end of a two-section, split drive frame 62 of the drive assembly 44. The frame assembly 62 supports four polyurethane pinch-wheels or rollers 64 that grip the hose 18. Adjusting bolts 66 and springs 68 control the tension or pinch pressure of the wheels 64 against the hose 18. Two pairs of the pinch-wheels 64 (only two of which are shown) are arranged 180° opposite each other to overly each other. The wheels 64 can also be positioned in other arrangements. The wheel material can also be varied as desired relative to the hose 18 to provide optimal friction and wear tolerance between the wheels 64 and hose 18.

A hand-operated valve 70 controls airflow from an air supply 69 through the swivel 60 and to a pair of air driven motors 72 secured to the frame 62. A drive axle 74 of each motor 72 is coupled to a drive gear 76. Power is directed via a chain 78 to a pair of follower gears 80 that are coupled to axles 82 that are secured to each drive wheel 64. The valve 70 is controlled to bi-directionally direct the hose 18 with a reciprocating motion at a desired axial speed to achieve proper tube cleaning, hose deployment and collection. A coupler 84 at the aft end of the frame 62 secures the frame 62 to the drive axle 42. Although an air powered transport drive is presently used, hydraulic, electric or other types of power drives can be adapted to the assembly 44.

The rate of movement of the hose 18 through the hose drive assembly 44 is regulated in relation to the rotational speed of the reel 20 to assure that the hose 18 is synchronously extracted and stacked to avoid kinking, strain or slack at the reel 20. The relative speeds also take into account the operating rigidity of the hose 18, which is relatively stiff when placed under the pressures discussed herein. Any of the latter conditions can unbalance the assembly 10. During a cleaning stroke, when the hose 18 is extended into a tube 16, the assembly 44 and reel 20 rotate at a slower speed. During hose retraction from the cleaned tube 16, when there is relatively little resistance to motion, the assembly 44 and reel 20 are rotated faster. The operator via the valve 70 manually controls the relative rates of rotation.

The relative rates are established empirically as required to meet the working conditions by regulating the air pressure at the valve 70 in relation to the constant drive power provided to the reel 20. An electric motor and V-belt/pulley transmission determine the rotational speed of the reel 20 which are discussed in more detail below. A variety of automatic control assemblies can also be adapted to the assembly 10 to obtain automatic speed regulation, such as by monitoring the condition of the hose 18 at the reel 20 via appropriate sensors. Sensor feedback can be directed to the speed regulators at the assembly 44 and reel 20.

For jobs requiring multiple assemblies 10, cleaning time can be reduced and equipment operation improved by coupling the several assemblies 10 to the single air supply 69 and operating the assemblies 10 in complementary fashion. That is, as the hose 18 of one assembly 10 is directed in a cleaning stroke, the hose 18 of another assembly 10 is collected. The demand on the air supply is therefore substantially continuous.

Figure 4:
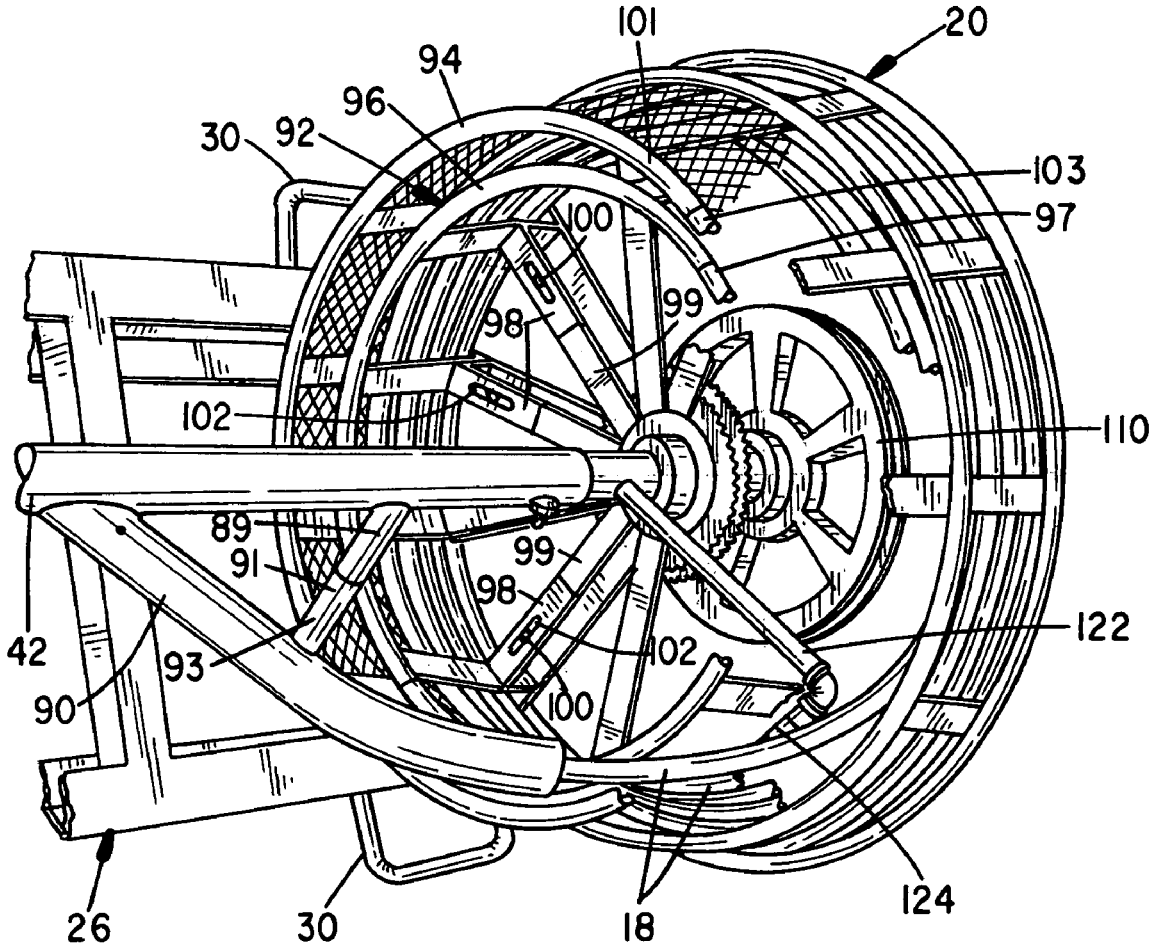
FIG. 4 is a perspective view to the hose collection reel with a length of spray hose arranged on the hub and also showing length adjustable link arms and end hoops of the hub.

With attention to FIG. 4, the hose 18 passes through a bore 86 at the forward end of the drive axle 42 and a bore 88 of a layering arm 90 that extends from the side of the axle 42. The layering arm 90 directs the hose 18 onto a center hub 92 of the reel 20. The hub 92 is concentrically positioned relative to an outer cage 94 such that the hose 18 is deposited in a single, layered coil that is concentric to the drive axis of the assembly 10. The changing weight of the hose 18 and contained liquid is thus dynamically balanced to the assembly 10. The reel assembly 20 can also be constructed to provide for multiple side-by-side coil wraps. For example, the diameter of the hub 92 may be constructed to expand and contract dynamically via centrifugal force and/or automatically with a controlled linkage. The arm 90 can also be mounted to pivot relative to the hub 92 to control layering. In the latter regard, the arm 90 can be hinged to pivot at the axle 42 and the linkage arm 93 can be constructed in two telescoping sections 89, 91.

FIG. 4 also depicts adjustment features of the reel assembly 20. That is, the fore and aft diameters of the hub 92 can be adjusted at the interconnected, telescoping hoop pieces 96, 97 and length adjustable spoke pieces 98, 99. Proper adjustment of the hub 92 can be arranged to be cylindrical or provide a taper. The hub 92 is presently constructed to taper inward as it extends forward and accommodates a single, stacked coil of hose 18.

The hoops 96, 97 and spoke pieces 98, 99 are adjusted in concert with a number of fasteners 100. Slots 102 in the spoke pieces 98, 99 overlap the fasteners 100. The outer cage 94 can also be constructed with adjustable hoops 101, 103 and spoke pieces 104, 105 relative to slots 102 and fasteners 100 as shown by representative example at FIGS. 4 and 5. Still other adjustable arrangements at the layering arm 90 and hub 92 can be provided to balance multiple coils, yet maintain a concentric assembly.

Figure 5:
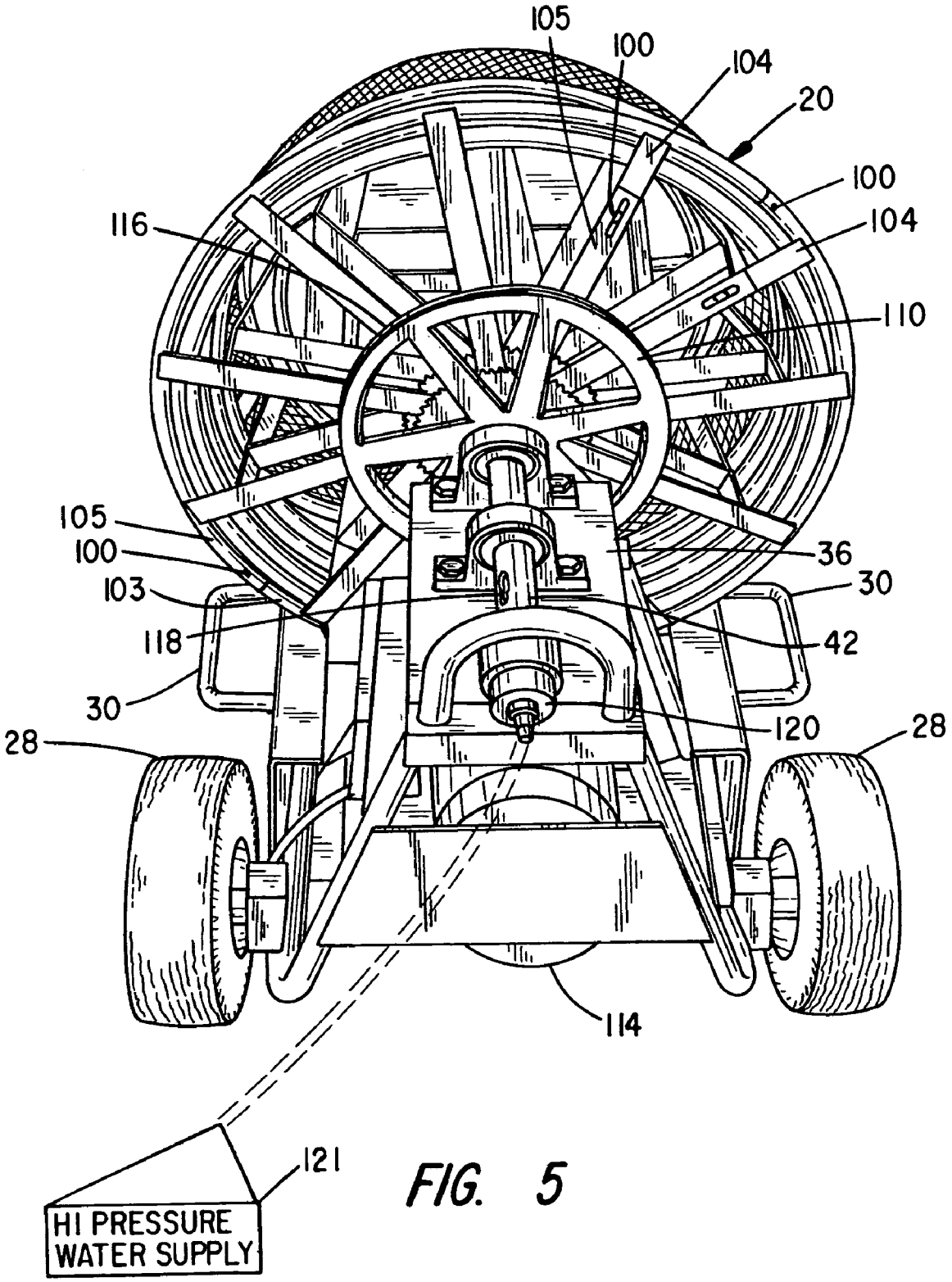
FIG. 5 is a perspective view to the aft end of the hose reel showing the adjustable link arms and end hoops of the outer cage.

FIG. 5 depicts a drive pulley 110 that is secured to the aft end of drive axle 42. Rotational drive power is supplied to the axle 42 from another pulley attached to via a drive motor 114 and belt 116. The rotational speed can be varied as desired by adjusting the relative diameters of the motor pulley to the drive pulley 110. The assembly 10 has been operated at speeds in excess of 400 rpm and approaching 650 rpm without experiencing vibration. This is in contrast to maximum operating speeds of 60 rpm for competitive assemblies.

A bore 118 at the aft end of the drive axle 42 is coupled to a swivel 120 and a high-pressure water source 121. Water is directed through the swivel 120, axle 42, a stub pipe 122 and coupler 124 to the hose 18. The working spray pressures can be varied as desired. Presently, pressures in the range of 4,000 psi to 36,000 psi are preferred when cleaning tubes found in boilers and evaporators.

Figure 6:
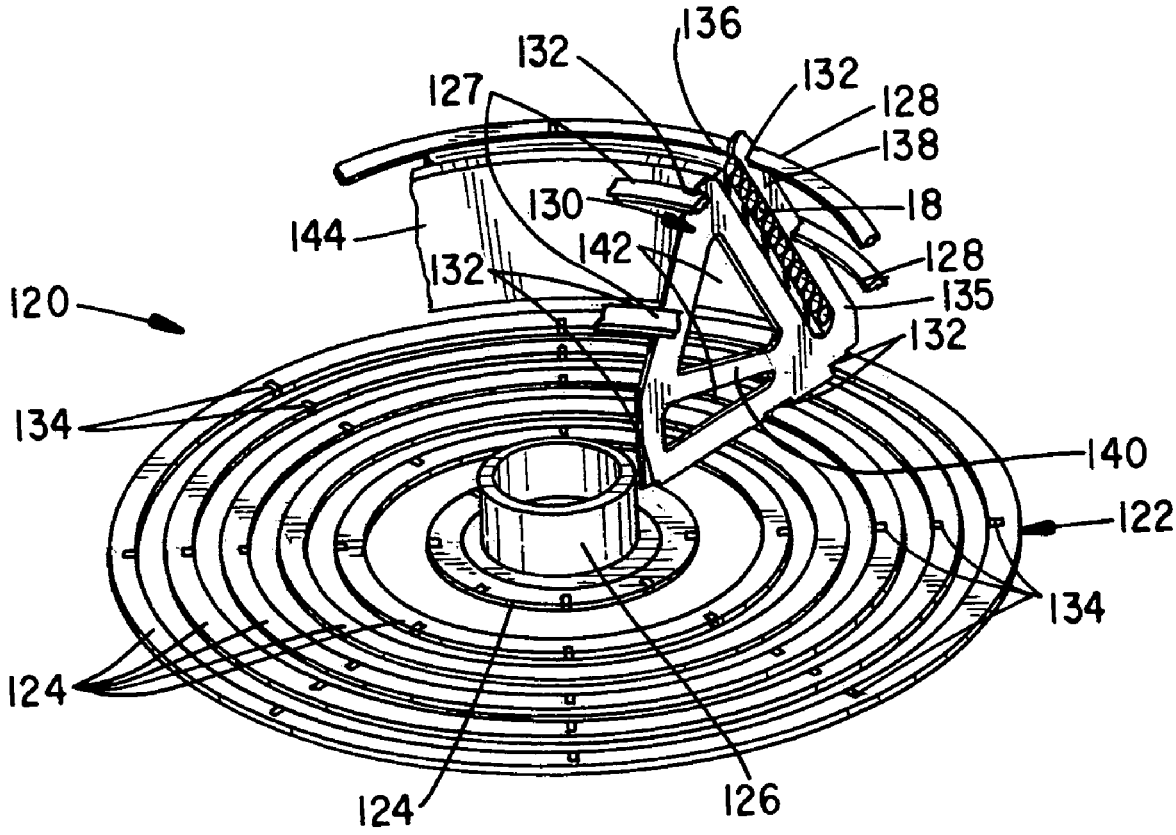
FIG. 6 is a perspective view shown in partial section to an alternative hose collection reel having an outer cage and to which a number of removable upright strut plates are attached to accommodate differing hose lengths and diameters.

FIG. 6 discloses an alternative reel assembly 120 that can be adjusted with relative ease to accommodate hoses 16 of different diameter and length. The reel assembly 120 provides a base 122 that is defined by a number of annular bands 124 and a center collar piece 126 that mounts to the axle 42. A number of inner and outer cage bands 127 and 128 are vertically offset from the base 122. The base and cage bands 124, 126 and 128 are coupled (e.g. welded) to a number of upright, planar strut plates 130 at notches 132 let into the peripheral edges of the plates 130.

Only one strut plate 130 is shown, but it is to be appreciated that several other identical plates 130 are mounted to align with notches 134 at each of the bands 124 and mate with the bands 124, 127 and 128. The assembly 120 provides for eight plates 130, but the number of plates 130 can be varied as desired.

A hose collection channel 136 is defined at each plate 130 between an outer arm 134 and inner hub 140. A number of coils of the hose 18 are shown as they appear when layered in the channel 136. The channels 136 project at an acute angle relative to the base 122 as they extend inward toward the collar 126 to define a tapered hose storage space.

The assembly 120 can be constructed of a variety of materials, although aluminum is presently preferred to reduce weight. Weight relief holes 142 are also provided in the plates 130.

The channel 136 is constructed oversized to nominally accommodate hoses from ¼ to 2-inch diameters. When a smaller diameter hose 18 is being used, a frustum shaped spacer 144 is also mounted in the channel to take-up space and assure the hose is layered in uniform coils.

The strut plates 130 thus define several vertical ribs that collectively capture and contain the hose 18 in relation to the layering arm 90. The reel assembly 120 can be adapted to accommodate hoses 16 of different diameter and length upon attaching an appropriate spacer 144.

FIGS. 7 through 14 depict an improved, modular high-pressure spray cleaning assembly 150. The cleaning assembly 150 is generally capable of performing the same cleaning functions as the assembly 10, but includes numerous modifications that enable the spray cleaner 150 to meet tube-cleaning standards not previously met by any competitive cleaning method or apparatus, for example chemical, water jet, or mechanical cleaning equipment. Most notably, the cleaning assembly 150 has demonstrated an ability to clean or strip debris from evaporator tube walls at petrochemical facilities to essentially bare metal and particularly to the point that allows the use of available "Iris" testing equipment. Iris testing equipment, which is generally available and based on defined "ultrasound" practices, measures the integrity, thickness and life expectancy of industrial thermal transfer tubes. Previously, other available cleaning techniques have met with only limited success in stripping residue and such that equipment owners have not been able to obtain meaningful thermal transfer and life cycle measurements at the cleaned tubes.

Moreover, the assembly 150 has achieved such cleanings in single passes of the cleaning hose 18 at rates on the order of 30 seconds for partially plugged, nominal 30–40 foot long tubes, and six minutes for similar tubes that were completely plugged. Such cleanings have been achieved at operating water pressures of 12,000–20,000 PSI. The obvious advantages to equipment owners are reduced down time for cleaning, longer periods between cleanings, better information from which to make tube replacement decisions and improved operating and thermal transfer efficiencies at the cleaned equipment.

Where the assembly 10 principally relied on an electric power source, it was been discovered that many industrial sites do not provide adequately regulated electric power. Low and under-voltage conditions were particularly problematic with the operation of the assembly 10. The assembly 150 therefore was designed to operate from a regulated, low pressure control air source.

Among numerous improvements in the cleaning assembly 150 and with attention to FIGS. 7–9 and 11, an improved belt drive assembly 152 has been adapted to the assembly 150. The belt drive assembly 152 is air driven and located central of a support frame 154 and coupled to the aft end of an improved hose drive or transport assembly 156. Where synchrony between the hose drive assembly 44 and the hose take-up reel 20 was previously maintained via the central axle 42, the assembly 150 no longer requires the connecting central axle 42 or the reel drive motor 114, pulleys 110 and belt 116. Instead, the assembly 150 drives only the hose drive assembly 156 via an air operated motor 160 (e.g. 1.5 hp), pulleys 162 and 164 and an interconnecting belt 165.

The hose take-up reel 158 passively follows rotation of the hose drive assembly 156 via the action of storing and extracting the hose 18 from the reel 158. That is, as a hose layering arm 166, which is attached to an end plate 168 and pressed bearing 170 adjacent the pulley 164, rotates with the hose drive assembly 156, the open end 167 of the layering arm 166 rotates about the peripheral edge of the hose take-up reel 158 and steers the hose 18 into a provided storage channel space 169. The rotation of the layering arm 166 and the stiffness or the hose 18 induces the hose reel 158 to rotate independent of the hose drive assembly 156, typically at a slower rate of speed.

Figure 12:
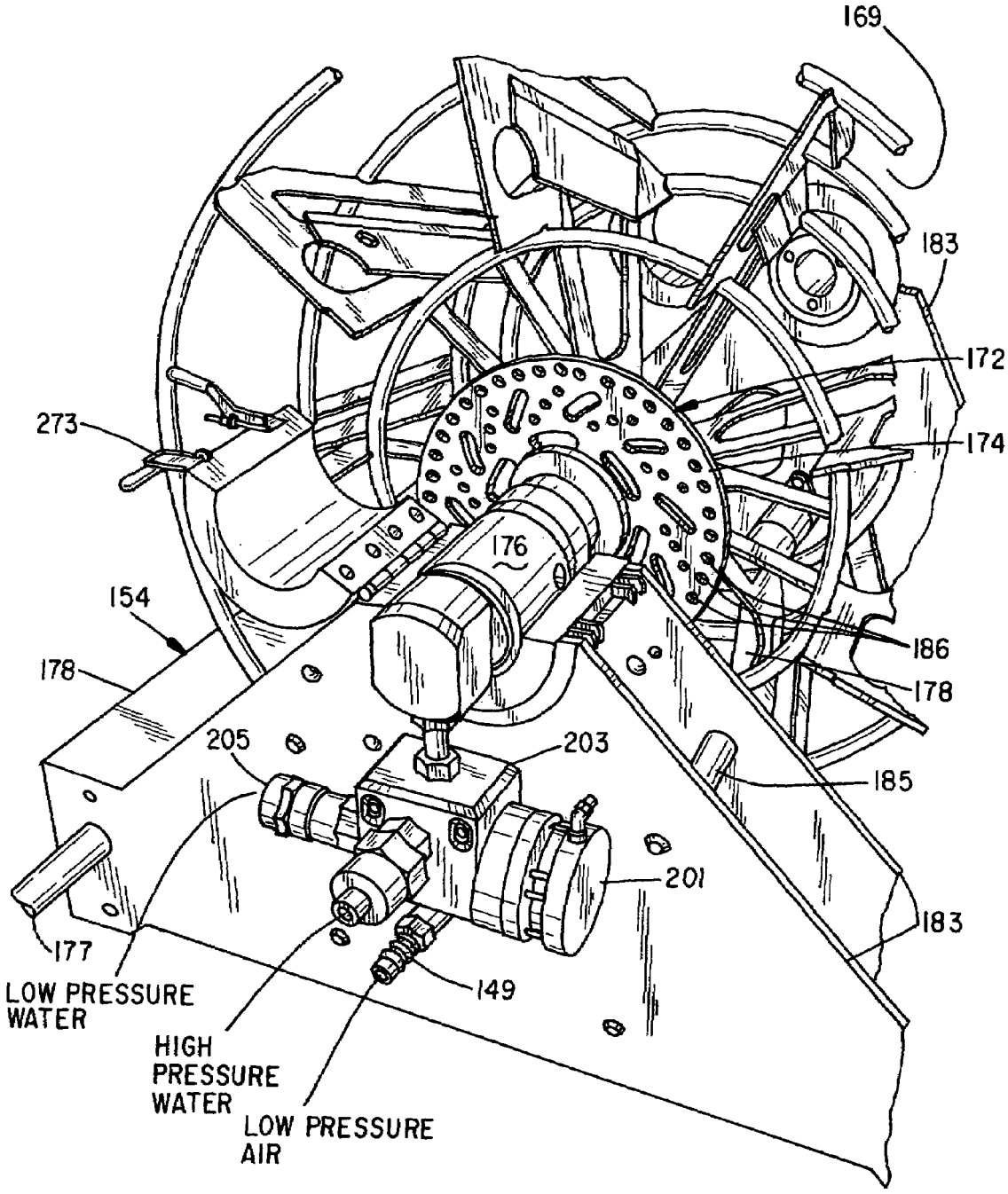
FIG. 12 is a perspective end view to the improved hose collection reel, clamp support, air brake and high-pressure water coupler.

An air operated, disk brake assembly 172 is mounted adjacent the aft end of the take-up reel assembly 158, reference FIG. 12. A disk brake 174 is mounted to a reel support swivel/axle 176 and a caliper 178 is mounted to the support frame 154. The brake assembly 172 operates to stop and/or control the rotational speed of the reel 158 relative to the reciprocating motion of the hose 18. The hub 180 of the take-up reel 158, otherwise, is positioned forward of the disk 174 at the approximate center of the reel 158. A latching clamp 273 secures the outer housing of the swivel/axle 176 to the support frame 154.

Figure 13:
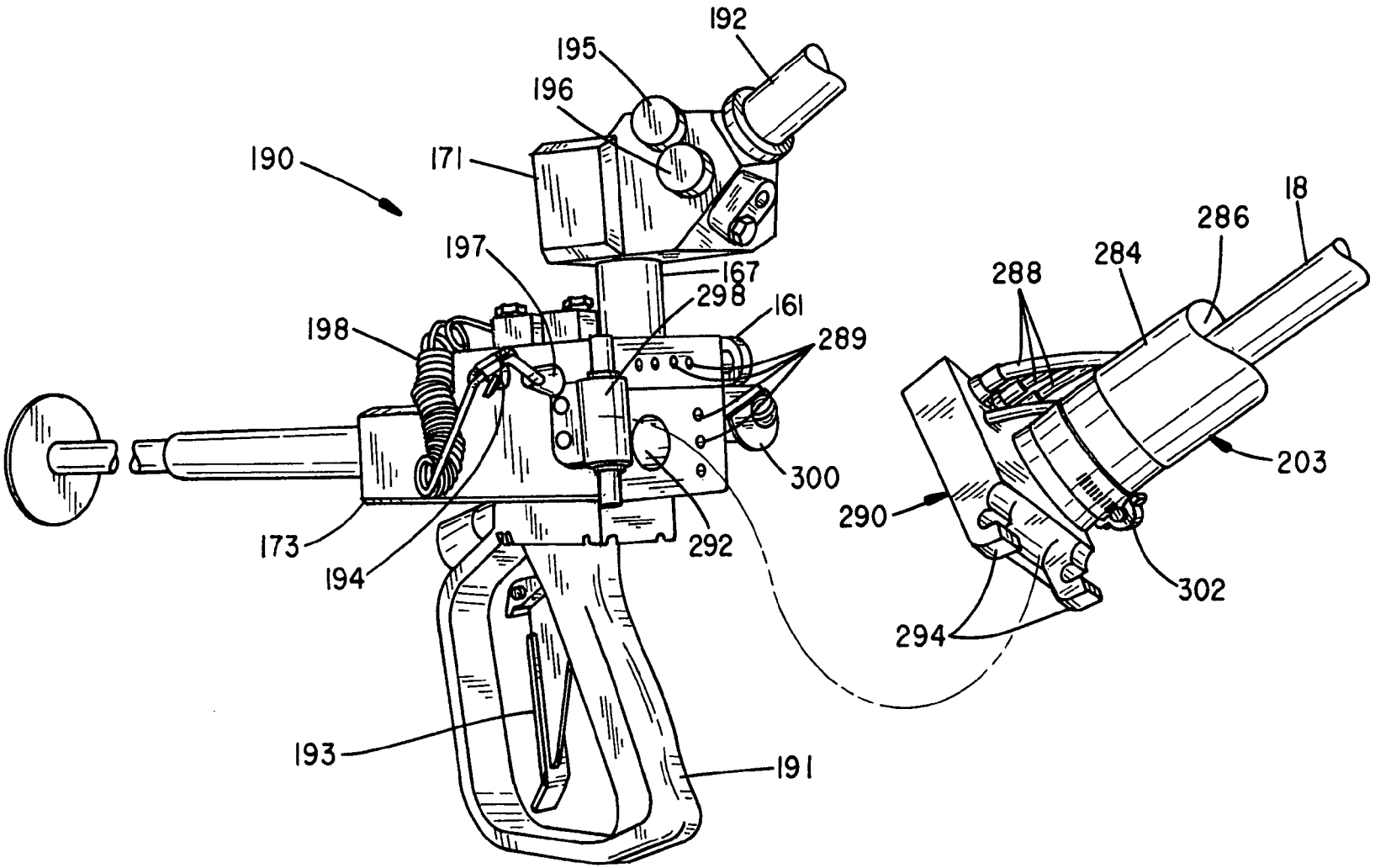
FIG. 13 is a perspective view shown in exploded assembly to the operator control gun assembly with attendant air control valve bodies and a detachable extension sheath.
Figure 14:
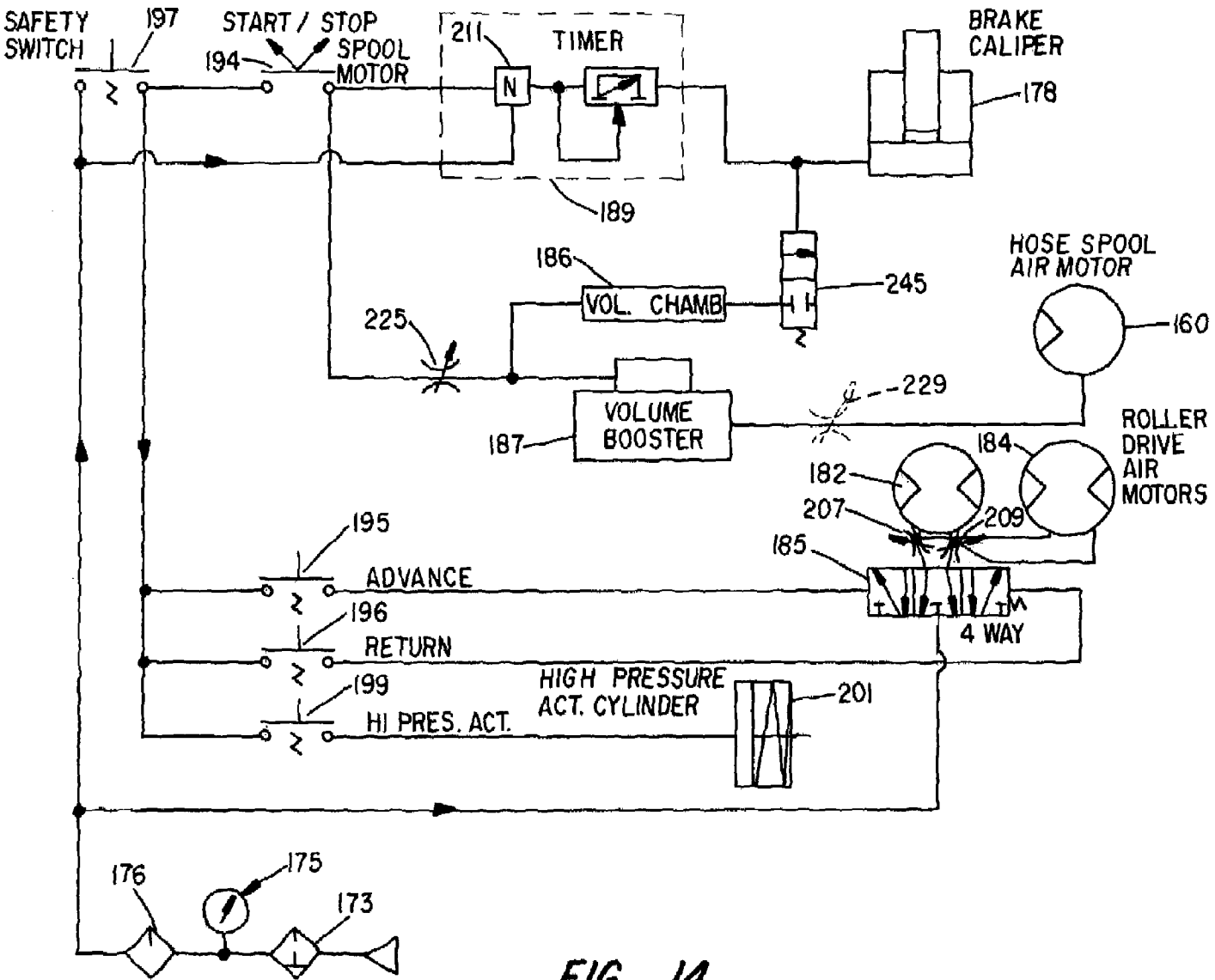
FIG. 14 is a control schematic to the pneumatic air and water subsystems.

Hose movements are controlled with a hand-held operator control or hose delivery gun 190 shown at FIG. 13. See also FIG. 14 in regard to the pneumatic control of the assembly 150. The gun 190 provides a primary handgrip 191 that extends from a primary valve block 173. A secondary handgrip 192 extends from a secondary valve block 171. An axle piece 167 couples the valve blocks 173 and 171 to one another and is mounted to rotate in the valve block 173, thereby permitting the rotation and latching of the handgrips 191 and 192 at several preferred relative mounting positions (e.g. 0, 45 and 90 degrees). A spring biased latch pin 161 is mounted in the side of the valve block 173 and cooperates with several mounting apertures (not shown) in the axle 167 to fix the handgrips 191 and 192 at one of the available positions and facilitate use of the control gun 190 with either horizontal or vertically arranged tubes.

A lever-actuated squeeze trigger 193 controls a water supply valve 199 in the primary block 173. The water supply valve 199 separately controls the delivery of control air to a high-pressure actuation cylinder 201 at a hi-pressure water manifold 203 mounted to the aft end of the assembly 150. During normal cleaning, the activation of the valve 199 directs control air to the cylinder 201, which causes a hi-pressure water source to be coupled to the hose 18. Releasing the trigger 193 deactivates the cylinder 201 and disconnects the hi-pressure water from the hose 18. Low-pressure water then drains from the hose 18 at a discharge outlet 205.

If an "emergency stop" condition occurs during a cleaning operation, such as if the operator and gun 190 become disconnected and a tether 198 pulls a cap from the emergency stop or "dead man" switch/valve 197 in the primary block 173, control air is prevented from flowing to the valve 199. Cylinder 201, in turn, is prevented from directing a flow of pressurized water from the manifold 203 to the hose 18.

The actuation of the "dead man" switch/valve 197 also disconnects the supply of control air to the motors 160, 182 and 184, which respond and stop the rotation and axial hose movement at the hose drive assembly 156. The loss of control air from the toggle switch/valve 194 to the timer 189 separately enables the timer 189 via an internal logic "not" gate 211 and activates the caliper 178 to grip the brake 174 and stop the hose take-up reel 158.

A toggle type, "start/stop" hose drive switch/valve 194 controls airflow to the motor 160 to induce rotation of the hose drive assembly 156 in one direction. The assembly 156 normally rotates in a clockwise direction relative to the hose reel 158 when looking forward from the back. Push button type switches/valves 195 and 196 in the secondary block 171 separately supply control air to a four-way valve 185 to appropriately induce hose "advance" and hose "return" movements of the reversible pinch wheel drive motors 182 and 184. The advance and retract speeds of the motors 182 and 184 are independently regulated with a pair of hand control valves 207 and 209 that are coupled to the motors 182 and 184. The valves 207 and 209 are empirically adjusted for each cleaning operation in relation to the amount of residue contained in the tubes being cleaned to optimize axial hose movement relative to residue removal. The valves 207 and 209 presently accommodate advance and retract speeds in the range of two feet/minute to nine feet/second.

Additional controls are provided to accommodate the inertial forces of starting and stopping the assembly 150 and to prevent related kinking and/or spillage of the hose from the hose reel 158. During a "stop" condition and with the loss of control air from the toggle switch/valve 194, control air to the input of a volume booster 187 is disabled and the motor 160 stops.

Simultaneously with the operator's action of disengaging the switch 194, the disk brake 174 is engaged to slow the hose reel 158 and prevent hose spillage. The "not" gate 211 (i.e. 3-way valve) is enabled and initiates the pneumatic logic timer 189. The timer 189 after a regulated time delay (e.g. 1.0 to 2.5 seconds) times-out and releases the brake. The control air from the timer 189 also enables a "bleed" valve 175, which opens a flow path to the atmosphere from a suitably sized volume chamber 186. The volume chamber 186 delays the stopping of the hose drive/spool motor 160 by bleeding residual air from associated the chamber 186, supply lines and a volume booster 187 that feeds the motor 160, a sufficient time for the caliper 170 to fully engage and prevent hose spillage.

During a "start" condition and with passage of control air from the toggle switch/valve 194, the not gate 211 disables the timer 189 and prevents airflow to the brake 178. The air volume booster 187 separately admits a regulated volume of air determined by a hand control valve 225 to the drive motor 160 to induce the motor 160 to accelerate to a desired operating speed. The hand control valve 225, like the valves 207 and 209, is empirically adjusted in relation to the residue condition of the tubes and typically is adjusted to operate the motor 160 in a range of approximately 300 to 400 RPM.

The rate at which the speed increases at the motor 160 is also initially limited by the volume chamber 186, which passively and parasitically leeches control air away from the booster 187, until the accumulator 186 is filled. The ramping up and down of the motor 160's speed during the starting and stopping operations serves to prevent kinking and spillage at the hose 18.

A separate hand control valve 229 is shown in dashed line that can be included to restrict the speed of the motor 160 to an exemplary range of 10 to 30 RPM to permit cleaning pipes carrying industrial liquids, chemicals and water.

Control over the operation of the cleaning assembly 150 is thus principally achieved with manually directed valves. Other sensors (e.g. magnetic, electro-optic etc.) and automatic controls, for example, can be adapted into the assembly 150 to monitor movement of the hose 18 and/or suitably pulse the brake assembly 172 with each required change in hose travel direction. That is, as the rotational direction of the hose drive wheels 202 are changed via the release and re-direction of airflow to the pinch wheel motors 182 and 184, the take-up reel 158 can be partially braked in synchrony with each directional transition to relieve stress on the hose 18 and facilitate the axial transition.

In the foregoing regard, a number of holes 186 displaced about the periphery of the brake disk 174 can cooperate with associated magnetic or photo-optic sensors 161 aligned to the holes 186 and/or timing marks on the surface of the disk 174 to monitor the rotation rate of the brake disk 174. Similarly numerous holes 188 in the pulley 164 or other surface targets at the moving pulley 164 can accommodate a monitoring of the rotational speed of the hose drive assembly 156. Combined with suitable air control devices, logic circuitry and/or a microprocessor controller, a relational control and regulation can be provided between the rotational movement of the hose drive assembly 156 and the take-up reel 158 to control the axial displacement or travel distance of the hose 18 and/or regulate the transitions of the hose 18 on and off the hose reel 158 to maintain a taught, non-erratic or steady movement condition at the hose 18.

Figure 7:
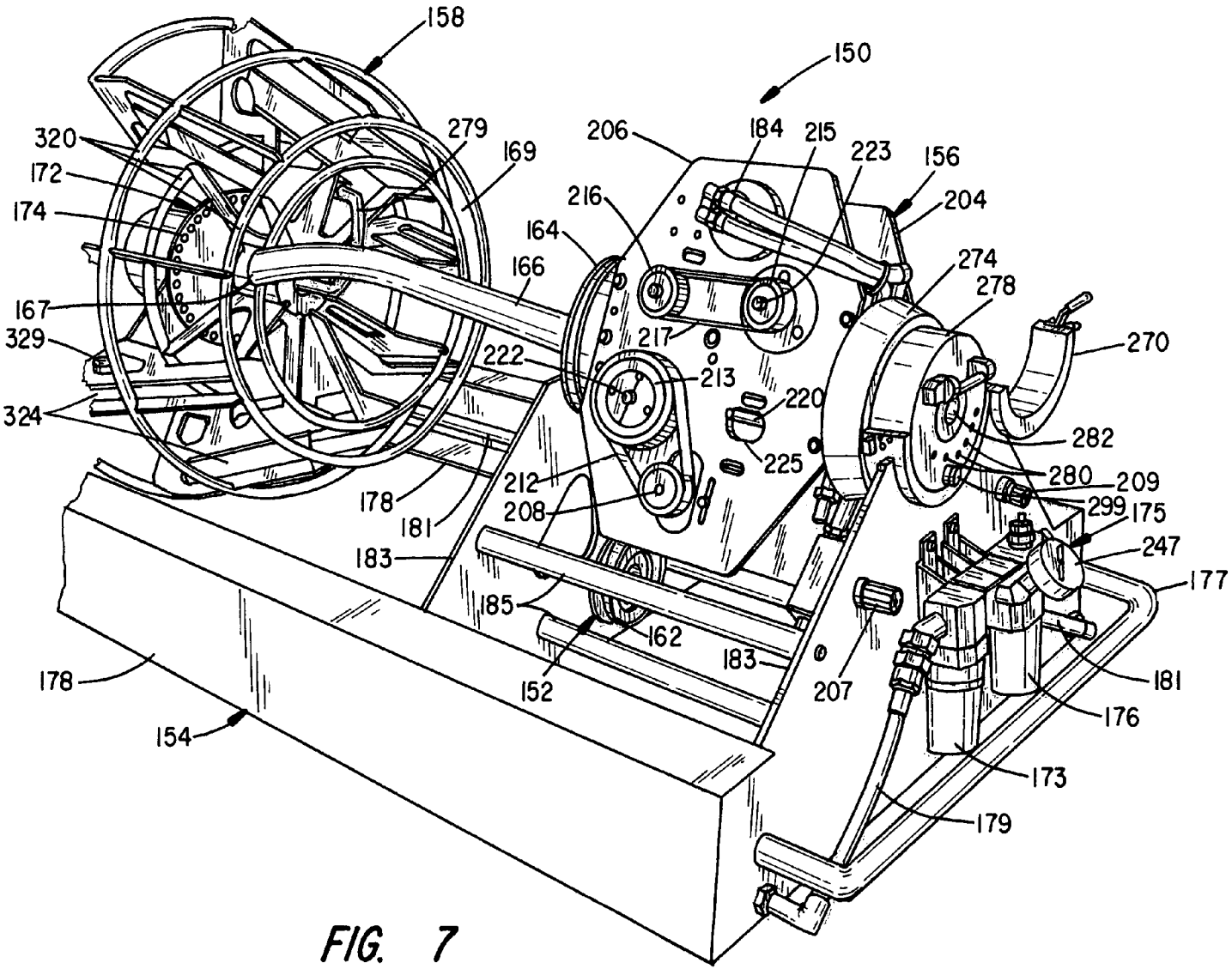
FIG. 7 is a perspective drawing showing an improved assembly of the high-pressure spray cleaning equipment of the invention and exposing the various clamp mounted modular subassemblies.
Figure 11:
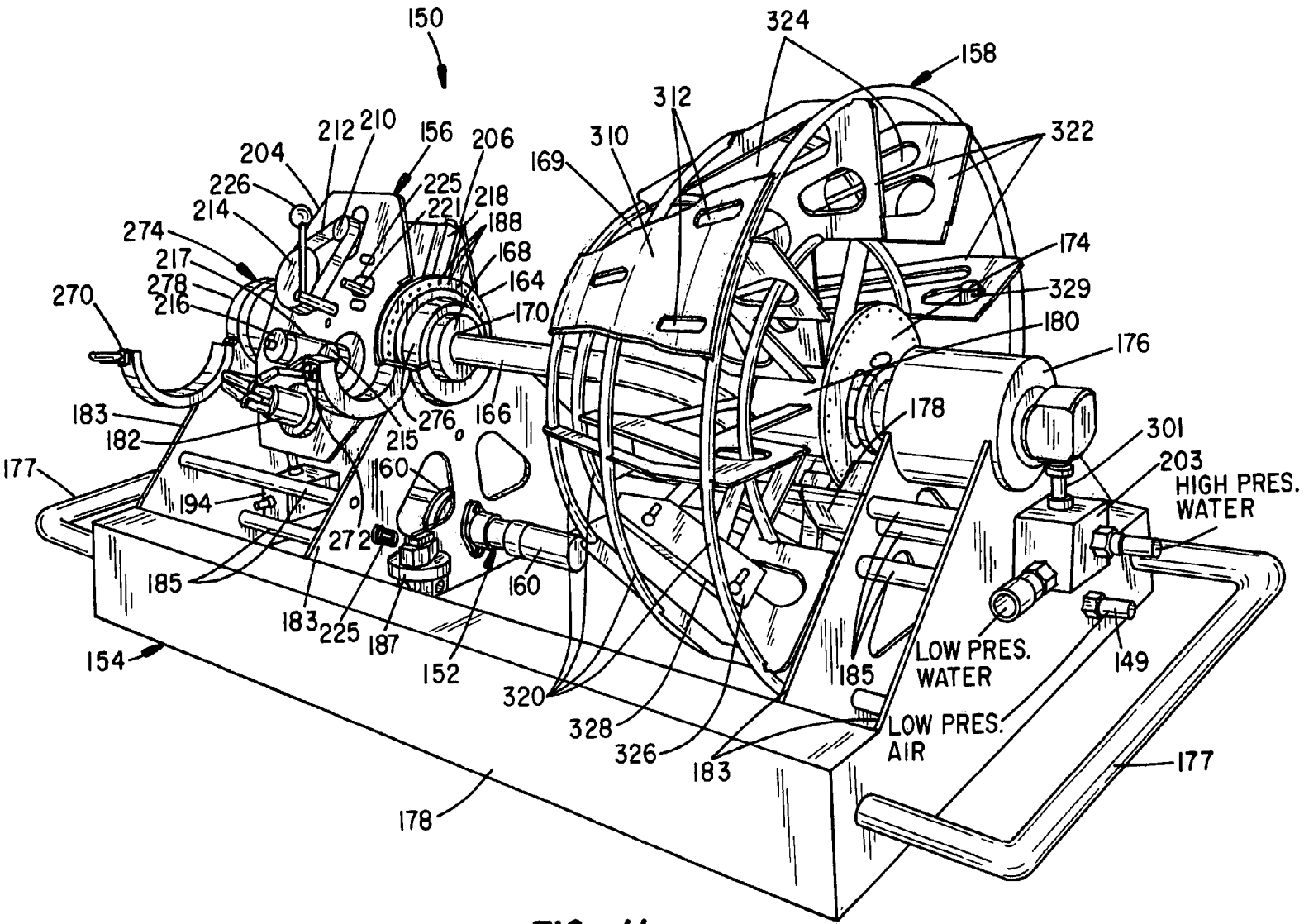
FIG. 11 is a perspective view to the air belt drive and an improved hose collection reel with a shifted hub and disk/caliper brake assembly and wherein a portion of a solid cover shield is shown at the hose reel.

A low-pressure control air source (not shown) is coupled to the assembly 150 at a quick-connect coupler 149 secured to the aft end of the framework 154, reference FIGS. 7, 11 and 12. Flexible braided air conduits 179 and tubular manifolds 181 routed through the frame 154 direct the air to and from a pneumatic air conditioning assembly 175 mounted to the fore end of the framework 154, adjacent a handle 177. A filter 173 (e.g. 40 micron element) removes rust, scale, water and other debris from the low-pressure control air. A lubricator/regulator 247 adds lubricant to the air and air controlled motors 160, 182 and 184 etc. The conditioned control air is directed from the assembly 175 via other distribution conduits 179 and 181 routed along the interior webs of longitudinal side frame channels 178. Smaller plastic/polyvinyl and rubber pneumatic control lines are tapped off the manifolds 181. Other air-controlled devices are similarly mounted along the channels 178 or to triangular vertical support webs 183 spaced along the length of the assembly 150. Suitable numbers of spacers and/or stiffener rods 185 extend between the webs 183.

Figure 8:
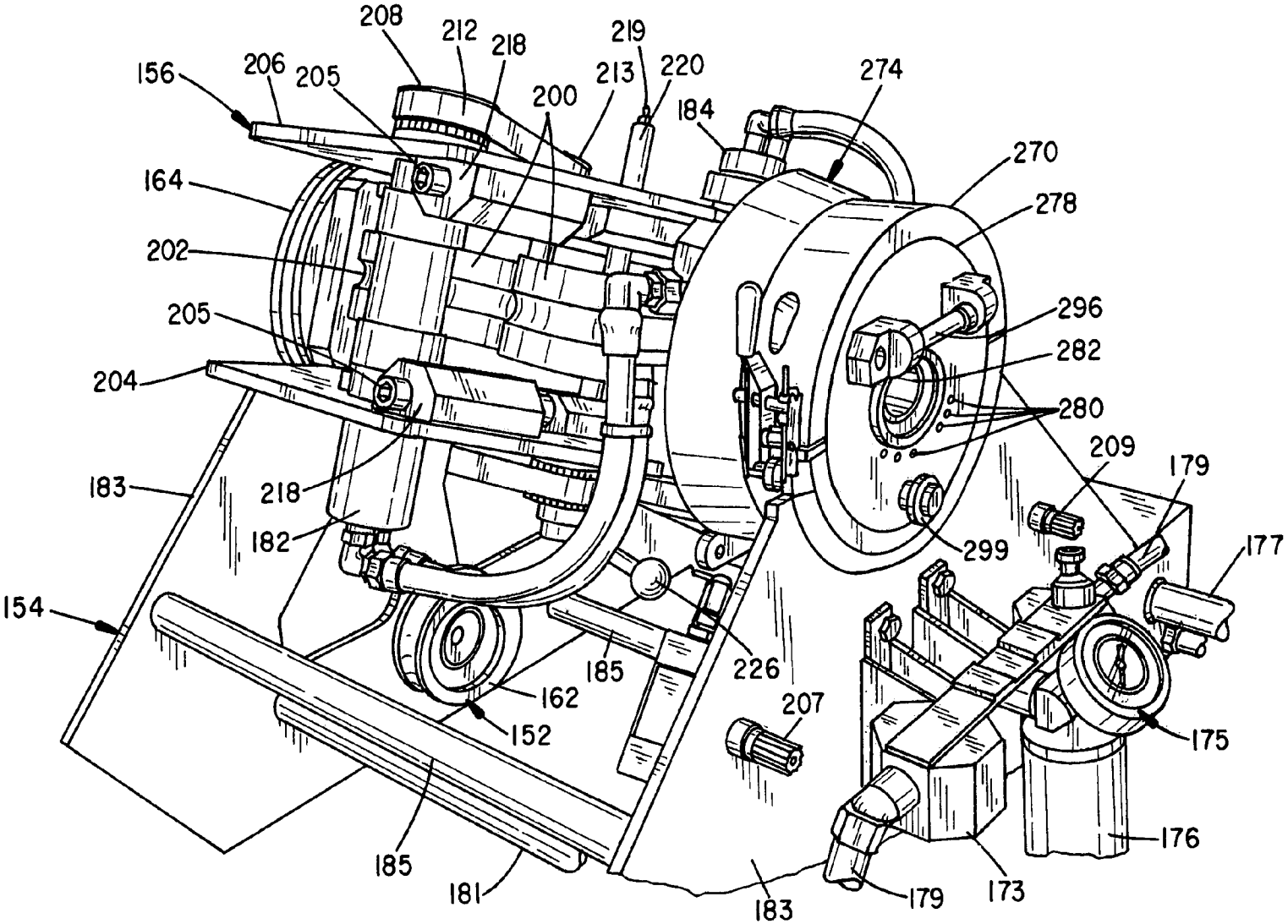
FIG. 8 is a detailed perspective view to the clamped, modular air/belt-driven hose transport drive assembly and the included air swivel, eccentric mounted paired sets of pinch wheels and wheel drive motors.
Figure 9:
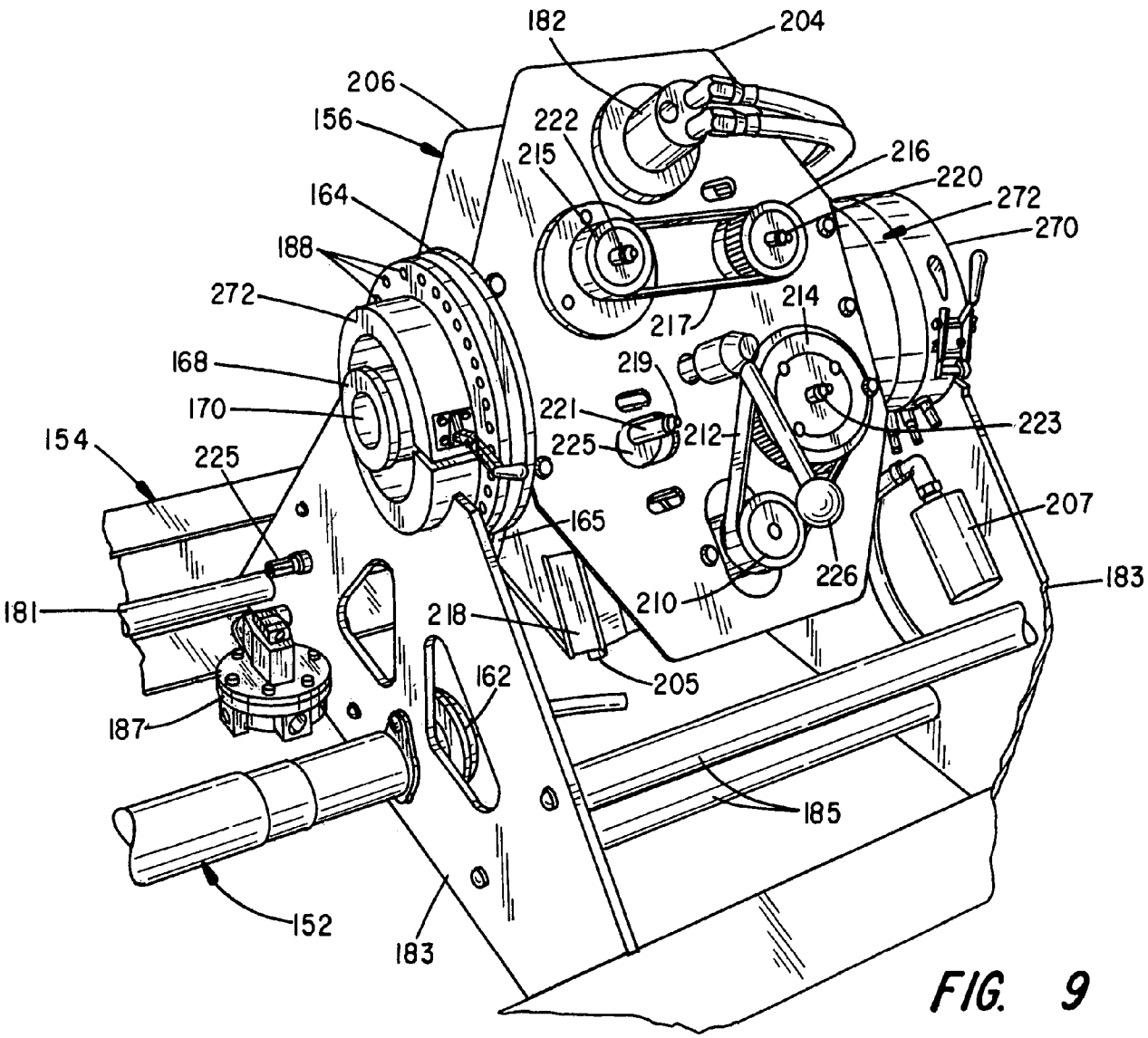
FIG. 9 is an enlarged perspective view of one side of the hose drive assembly.
Figure 10:
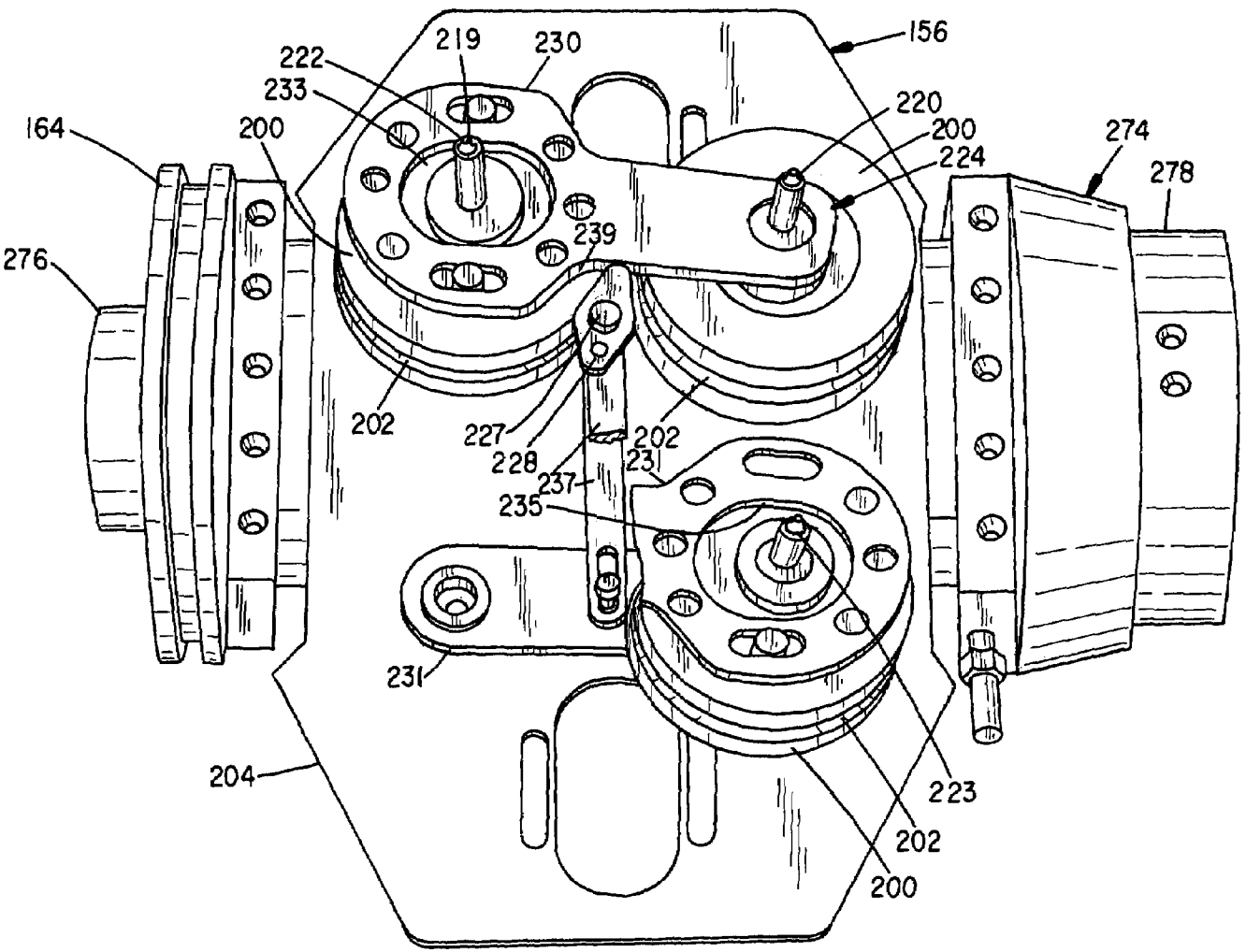
FIG. 10 is an enlarged perspective view of a partially disassembled hose drive assembly showing one of the two sets of eccentric pinch-wheel tightening linkages.

With continuing attention to FIGS. 7–9 and additional attention to FIG. 10, detailed views are shown to the construction of the hose drive assembly 156. The assembly 156 provides two sets of upper and two lower pinch wheels or rollers 200. Grooves 202 are let into the wheels 200 along the circumferential midline and are sized to grip and support the drive hose 18 as the hose 18 is directed through the control gun 190 and any extension sheath 203 coupled between the cleaning assembly 150 and gun 190.

The thickness and size of the wheels 200 are selected to be compatible with the outside diameter (OD) of the hose 18 to assure smooth hose travel, without marring and slippage, at the required equipment operating speeds. The wheels 200 presently exhibit a nominal four-inch diameter and 2-inch thickness. The wheels 200 are constructed of high-density urethane and exhibit a durometer in the range of 60 to 80. Wheels can be constructed from a variety of other materials and can include impregnated materials and/or belting or covering layers, provided the material is compatible with the hose material. The wheels 200 might also be coated with a material of appropriate durometer and density. The depth of the grooves 202 can be varied and are presently cut to accommodate a hose 18 having a 5 mm to 10 mm I.D.

The hose 18 is constructed from a high-density polyethylene. Other layered or wrapped materials and/or layers/wraps containing fiber strands might also be used. The covering at the hose 18 is especially susceptible to abrasion and must also be capable of operating at the required relatively high pressures. Reduced diameter hoses on the order of 4 to 6 mm are presently being considered for use in cleaning a variety of commercial and industrial equipment, for example small ID exchanger tubes in the range of ¾ to ½ inch ID or other liquid or gas supply lines.

The wheels 200 are secured between side plates 204 and 206. The drive linkages to the two sets of pinch wheels 200 are essentially identical and are mounted to exterior surfaces of the respective plates 204 and 206. Power is applied to the sets of wheels 200 from the air drive motors 182 and 184. The motors 182 and 184 are respectively first coupled to drive gears 208 and 210 that are interconnected via a belt 212 to follower gears 213 and 214. The gears 213 and 214 drive one of the sets of pinch wheels 200 and the other wheels 200 follow via separate gears 215 and 216 and drive belt 217. The axles of the wheels 200 coupled to the gears 213 and 214 are mounted in a stationary condition relative to the plates 204 and 206. The axles 220 and 221 of the other set of wheels 200 coupled to the gears 216 are mounted to pivot, and the details of which mountings are described below.

Two pairs of spring tensioner assemblies 218 determine the tension or pinch pressure exerted by the wheels 200 on the hose 18. A tensioner 218 is coupled to each end of a pair of floating axles 220 and 221 that support the gears 216. The other axles 222 and 223 coupled to the gears 213, 214 and 215 and wheels 200 are stationary mounted.

The tensioners 218 comprise spring-biased pillow blocks that contain the axles 220 and 221 and provide a range of axle motion that is limited by apertures 225 in the plates 204 and 206. The spring tension is typically adjusted empirically via a threaded member 205 such that the hose 18 is gripped sufficiently to move without slippage. A calibrated adjustment might also be performed. It is also to be noted that each of the axles 220 through 223 are bored and fitted with zerk fittings 219 to assure the delivery of proper lubrication to the supporting bearings at the gears 208, 210 and 213–216 and pinch wheels 200.

A duplex or two-stage linkage 224, shown at FIG. 10, separately rotates or directs the pivoting, spring-biased wheels 200, which are mounted to the axles 220 and 221, between released and contact positions relative to the hose 18. A handle 226 operates a pair of eccentric or cam pieces 228 (only one of which is shown) that are displaced along an axle 227. Each cam piece 228 lies in planar parallel relation to one of a pair of captured swing arms 230. The swing arms 230 are coupled to the axles 220, 222 on either side of one set of the pinch wheels 200. Another set of swing arms 231 are captured to the axles 221, 223 on either side of the other set of pinch wheels 200. Elongated apertures 233 and 235 are provided at the arms 230 and 231 in the region of the ends of axles 222 and 223, which allow the arms 230 and 231 to slide as the wheels 200 mounted to the axles 220 and 221 pivot toward and away from the hose 18.

The swing arms 231 are separately coupled to the cam pieces 228 with a pair of linkage arms 237. The cam pieces 228 align to an eccentric surface 239 at the swing arms 230 such that as the cam pieces 228 rotate and follow the eccentric surfaces 239, the axle 220 and pinch wheel 200 is pivoted. The linkage arms 237 transfer the motion to the swing arms 231 to pivot the axle 221 and associated pinch wheel 200 in unison toward or away from the hose 18.

Motion of the axles 220 and 221 is opposed by the preloaded spring tension of the tensioners 218. Rotation of the cam pieces 228 past an over-center point induces the wheels 200 to either grip or release the hose 18.

During the initial stringing of the hose 18 through the hose-layering arm 166, end plate 168 and pressed bearing 170, the handle 226 is rotated to a release condition wherein the wheels 200 are separated and don't contact the hose 18. Once rotated to a gripping condition, the tensioners 218 are adjusted to obtain a desired contact force with the hose 18. Thereafter, the hose drive assembly 156 can be replaced by merely releasing and extracting the hose 18 without having to re-adjust the tension.

Release of the hose drive assembly 156 is achieved by releasing forward and aft latching clamps 270 and 272 from an air swivel 274 that is supported to the fore end of frame 154 and an aft end bearing 276 adjacent the drive pulley 164. The air swivel 274 rotates on a large diameter, bearing surface 278, which is held to the frame with the split latch collar and a locating or positioning pin 277.

Internal porting at the air swivel 274 directs the control air to a number of O'ring sealed control air ports 280 (i.e. six air pilot bores) that are arrayed about a central bore 282 at the swivel 274. Other control air ports 280 are located in the collar, reference FIG. 16. The ports 280 at the collar couple control air to the motors 282 and 284 and between the operator control gun 190 and support frame 154. The hose 18 extends through the bore 282 at the swivel 274 into the operator control gun 190 or extension or transition assembly 203. The extension assembly 203 interlocks and clamps to the air swivel 274 and the operator control gun 190.

The extension or transition assembly 203 provides a durable and flexible tubular cover piece or conduit 284 of a suitable length. A bore 286 that contains and shields movement of the hose 18. Displaced from the bore 286 are a number of 5/32-inch pneumatic control lines 288 that terminate in clamp blocks 290 fitted to the ends of the conduit 284. Each clamp block 290 includes hook arms 294 that interlock and hinge with a pivot bar 296 at the air swivel 274 and a hinge axle 298 at the gun 190. A tapered or ramped flange surface 299 at the air swivel 274 and 300 at the operator gun 190 respectively interlock with a latch arm 302 at each block 290 to draw the blocks 290 into compressive alignment with the bores 280 of the air swivel 226 and bores 289 at the operator gun 190. The bore 292 of the control gun 190 is similarly coupled to the other clamp block 290. Control air flow to direct the functions of the assembly 150 via the control valves of the control gun 190 is thus coupled via the bores 289 and 280 and control lines 288 to the framework 154. Other types of latching couplers can be adapted to the ends of the transition assembly, e.g. the latches at couplers 270 and 272.

Returning attention to FIG. 11, the source of high pressure water (e.g. 200 to 50,000 PSI) is coupled to the manifold 203 and routed with a pipe 301 to a bored channel in the outer housing 275 of the swivel/axle 176. The pressurized water is directed from the outer housing 275 to the axle portion 281 of the swivel/axle 176 and which supports the hub 180. One or more other manifolds 279 extend from the axle portion 281 to couple the pressurized water to the hose 18. A tubular manifold 279 presently projects from axle portion 281 of the swivel/axle 176 and the hub 180 and aligns the hose 18 to the hose reel 158 to facilitate hose layering in the channel 169. Counter weights can be provided at the hose reel 158 to balance the manifolds 279.

The hose reel 158 is constructed of a number of circular bands of tubing 320 of varying diameter that are secured to a number of ribs or webs 322 that radiate from the hub 180. Each web 322 includes an open-ended channel 324 that collectively define the hose storage channel space 169. An adjustable plate 326 (only one of which is shown) is typically secured to each of the webs 322 and adjusted as desired to vary the width of the channel space 169. The plates 326 or peripheral edges of the plates 326 can also be lined with a high density, slippery material 328, which material can also be coated onto the plate 326 and/or web 322 to prevent abrading the hose 18. As necessary, counter weights 329 can be added to the webs 322 (e.g. to balance the manifold(s) 279) to assure a smooth rotation of the hose reel 158.

On infrequent occasions where relatively small diameter hosing 18 is required, the hose 18 has exhibited a tendency to escape from the interstices between the bands 320 and webs 322 of the hose reel 158. Operation must be halted to remove the kinks and/or loops and re-layer the hose 18 in the channel space 169. FIG. 11, depicts an external shroud 310 that mounts over or can replace selected bands 320. Apertures 312 are provided in the shroud 310 to relieve water and dirt that might attach to the exterior of the hose 18. A separate shroud 310 may also be included at the interior of the reel 158 between the hub 180 and channel space 169 to further confine the hose 18 and prevent kinking.

Figure 15:
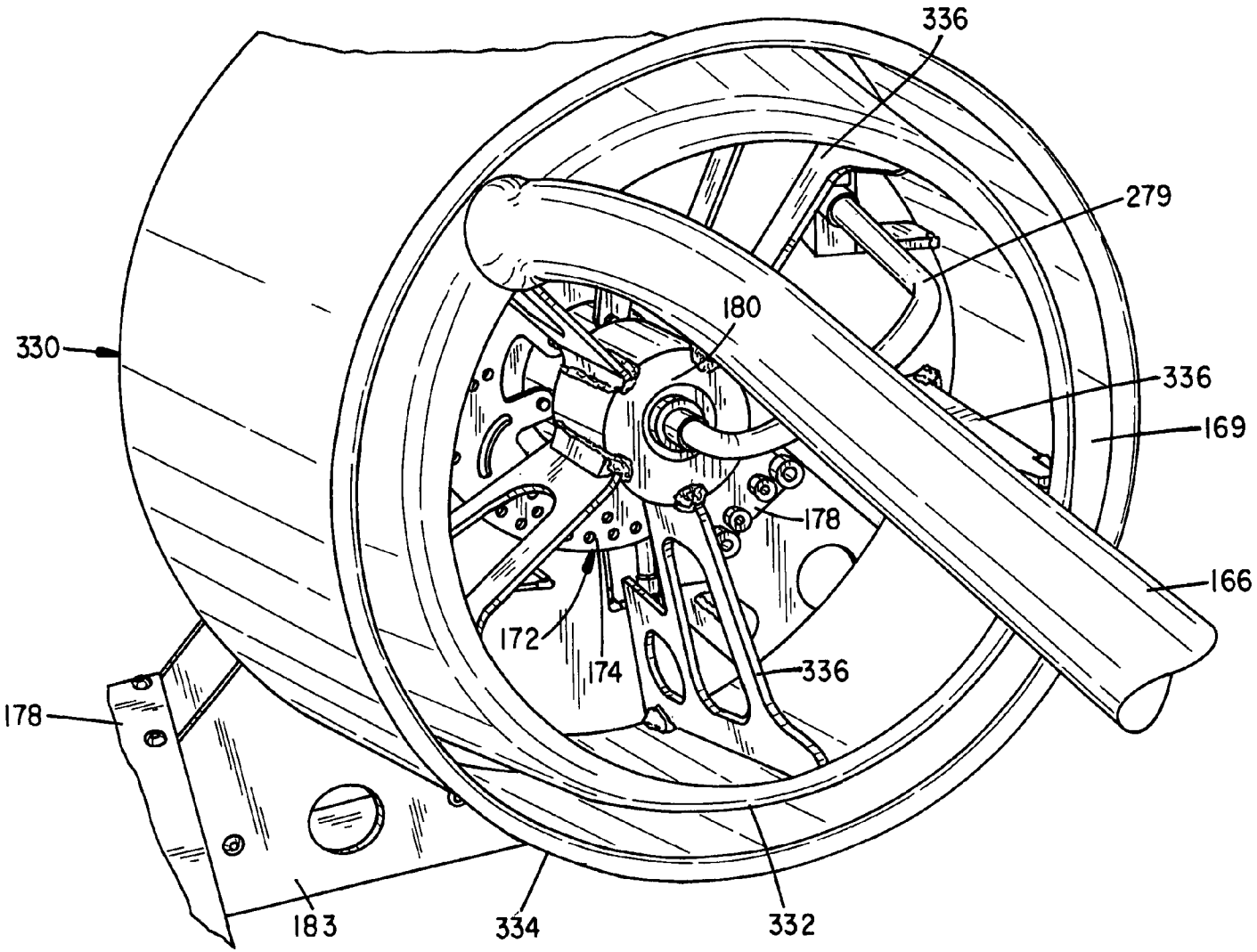
FIG. 15 is a perspective view to a hose reel having displaced interior and exterior sidewalls.

In the latter regard, FIG. 15 shows a fully enclosed hose reel 330 that has been constructed with inner and outer shrouds 332 and 334. The hose reel 330 requires relatively fewer webs 336 and the channel 169 is sized to a particular hose size. The channel space of the reel 330 is not presently adjustable. The reel 330 can be made adjustable by sectioning the interior shroud 332, providing spaces between the adjoining edges of the sections apart and including interior flanges that can be adjusted in relation to the webs 336 in the fashion for adjusting the spokes 98, 99 at FIG. 4.

Figure 16:
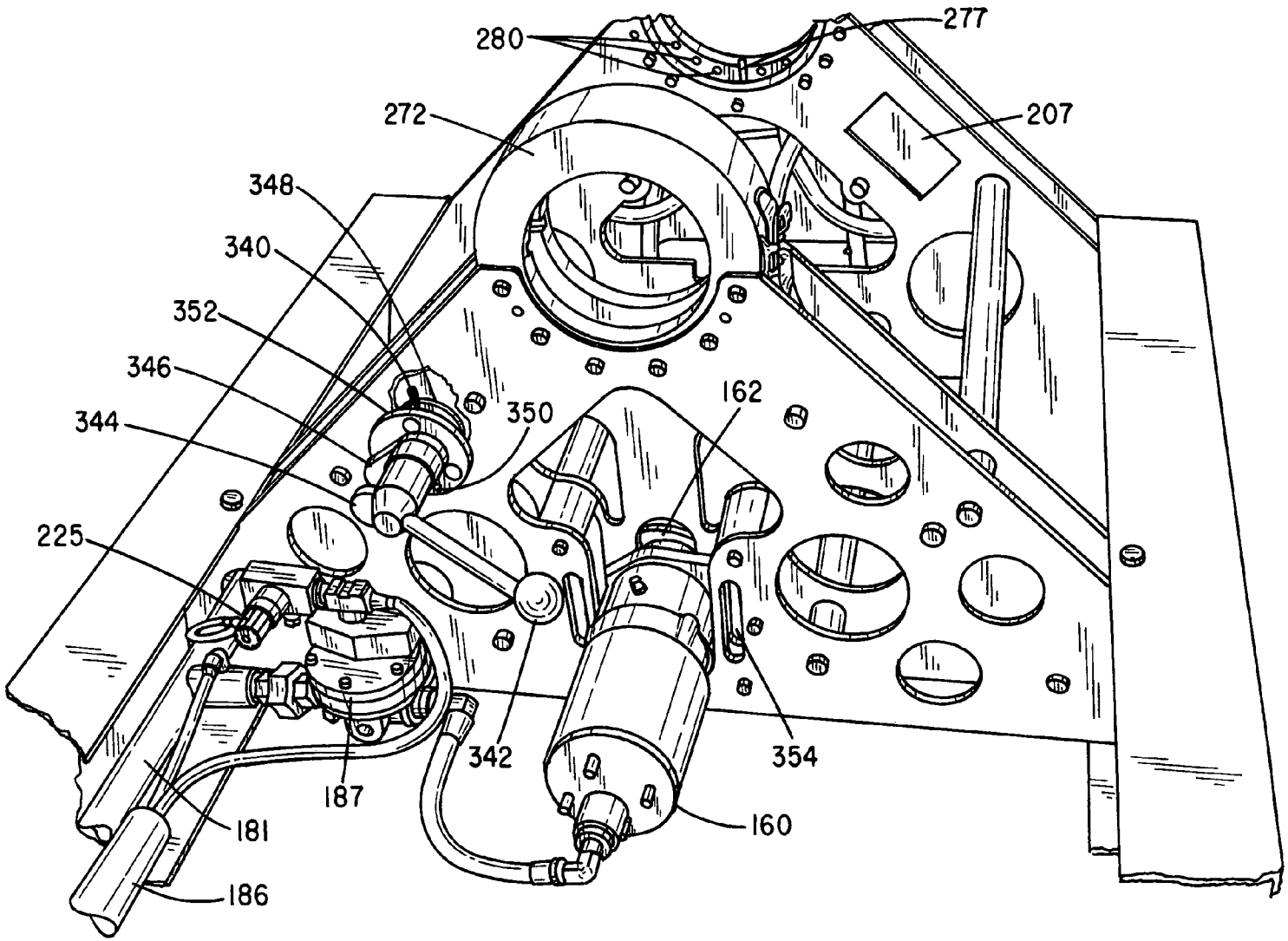
FIG. 16 is a perspective view to an adjustable hose drive motor and belt tensioner assembly.

A further refinement that has been adapted into the cleaning assembly 150 to facilitate repair and replacement of the hose drive assembly 156 is shown at FIG. 16. A tensioner assembly 340 is particularly shown that is used to tighten the drive belt 165; and which finds application for either a "V" or toothed drive belt 165.

The assembly 340 includes a handle 342, lock-pin 344, cam link arm 346 and idler pulley 348 (shown in partial cutaway). The handle 342 is mounted to selectively rotate the link arm 346 and idler pulley 348 relative to the drive belt 165 and vary or release the tension on the belt 165. A number of apertures 350 at a handle support collar 352 cooperate with the lock-pin 344 to latch the idler pulley 348 at a selected position. During removal and replacement of the hose drive assembly 156, the assembly 340 quickly releases and sets the tension on the drive belt 165 without having to adjust the drive motor 160 and/or latching clamps 270 and 272.

Also apparent from FIG. 16 are adjusting slots 354 whereby the motor 160 and drive pulley 162 are initially adjusted.

While the invention has been described with respect to several assemblies and considered improvements or alternatives thereto, still other constructions may be suggested to those skilled in the art. For example, the hose washing assembly 24, axial drive assembly 40 or 156 and/or adjustable reel assembly 20 or 158 and/or operator control gun 190 can be used in different combinations or can be provided in other cleaning system arrangements. The hose reels 20, 158 or 330 can be adapted into different combinations and chassis drive arrangements. The cleaning equipment can include other controls for adjusting the rotational and axial operating speeds. Sundry safety controls can also be provided. The foregoing description should therefore not be literally construed and should instead be construed to include all those embodiments within the spirit and scope of the following claims.

What is claimed is:

1. Apparatus for cleaning residue from a bore of a tube, comprising:

a) a hose having a spray tip containing a plurality of orifices;

b) a water source coupled to said hose and capable of delivering water to said hose at a pressure in excess of 1,000 psi; and c) a framework supporting i) transport means having a first motor for extending and retracting said hose with a reciprocating motion along a longitudinal drive axis, ii) a reel having a hose storage space concentrically aligned to said longitudinal drive axis and where at said hose is arranged in coils concentric to said drive axis, and iii) a second motor for rotating said transport means, whereby said hose and spray tip are rotated as said hose is collected and dispensed from said reel and as said reel passively follows rotation of said transport means.

2. Apparatus as set forth in claim 1 including an operator control gun coupled to said framework and having a bore through which said hose is directed.

3. Apparatus as set forth in claim 1 wherein said first and second motors comprise air motors.

4. Apparatus as set forth in claim 1 including means for selectively regulating axial hose travel to a range of 2 feet per second to 10 feet per minute.

5. Apparatus as set forth in claim 1 including means for selectively regulating the rotation of said transport means to a range of 10 to 400 RPM.

6. Apparatus as set forth in claim 1 including brake means coupled to said reel for controlling the speed of rotation of said reel relative to said transport means to prevent hose spillage and hose kinking.

7. Apparatus as set forth in claim 6 wherein said brake means comprises a disk brake mounted to said reel and a caliper mounted to said framework.

8. Apparatus as set forth in claim 1 wherein said reel includes a hub mounted concentric to said longitudinal drive axis, a plurality of planar webs radially projecting from said hub and each having a channel extending in parallel alignment to said longitudinal drive axis, wherein the channels of said webs are aligned to define said storage space, and wherein said transport means includes a tubular member having a bore through which said hose extends for directing said hose to and from said storage space.

9. Apparatus as set forth in claim 1 wherein said reel includes a hub mounted concentric to said longitudinal drive axis, a plurality of webs radially projecting from said hub in parallel alignment to said longitudinal drive axis, an endless shroud mounted to said webs in concentric relation to said longitudinal drive axis, and a second shroud displaced from said first shroud to define said storage space therebetween, and wherein said transport means includes a tubular member having a bore through which said hose extends and mounted to direct said hose to and from said storage space.

10. Apparatus as set forth in claim 1 wherein said transport means includes a tubular member having a bore through which said hose extends and mounted to direct said hose onto a storage surface of said reel.

11. Apparatus as set forth in claim 1 wherein said transport means includes a plurality of pinch wheels mounted to a support frame, wherein a linkage coupled to said support frame eccentrically pivots at least one of said pinch wheels to engage and disengage a circumferential surface of each pinch wheel into tangential contact with said hose and a tensioner for independently controlling the contact force of said pinch wheels with said hose.

12. Apparatus as set forth in claim 1 including disk brake means coupled to said reel and control means coupled to said first and second motors and said brake means for synchronously directing the axial and rotational movement of said hose to prevent hose spillage and hose kinking.

13. Apparatus as set forth in claim 11 wherein each of said plurality of pinch wheels includes a circumferential endless groove located to contain and direct the travel of said hose.

14. Apparatus as set forth in claim 1 wherein said transport means includes a plurality of pinch wheels mounted to a support frame, an eccentric linkage coupled to said support frame to pivot a pivoting one of said pinch wheels relative to a stationary pinch wheel between a first condition where at the pivoting and stationary pinch wheels are released from contact with said hose and a second condition where at the pivoting and stationary pinch wheels grip said hose and a tensioner for independently controlling the contact force of said pinch wheels with said hose, such that the tension is unaffected in either of said first and second conditions.

15. Apparatus as set forth in claim 1 wherein said transport means includes a tensioner for selectively controlling the contact force of an idler pulley with a drive belt coupled to said first motor between a non-contact position and a tensioned position.

16. Apparatus as set forth in claim 1 wherein said framework supports a control swivel having rotating and stationary portions, wherein a plurality of conduits extend from a remote operator controller and couple to porting at said stationary portion, and including a brake means mounted to said reel for controlling rotation of said reel, whereby said operator controller directs a control media to operate said first and second motors and said brake means.

17. Apparatus as set forth in claim 16 wherein said transport means includes a plurality of pinch wheels mounted to a support frame, an eccentric linkage coupled to said support frame to pivot a pivoting one of said pinch wheels relative to a stationary pinch wheel between a first condition where at the pivoting and stationary pinch wheels are released from contact with said hose and a second condition where at the pivoting and stationary pinch wheels grip said hose and a tensioner for independently controlling the contact force of said pinch wheels with said hose, such that the tension is unaffected in either of said first and second conditions.

18. Apparatus as set forth in claim 17 wherein said transport means is detachably clamped to said framework at said control swivel and is removable as a unit.

19. Apparatus as set forth in claim 16 wherein said transport means is detachably clamped to said framework at said control swivel and is removable as a unit.

20. Apparatus as set forth in claim 16 wherein said first and second motors comprise pneumatic motors, wherein said operator controller comprises a gun coupled to said stationary portion having a bore through which said hose is directed and including a plurality of pneumatic valves for directing pneumatic flow to direct axial movement of said hose and rotation of said transport means and reel.

21. Apparatus as set forth in claim 1 wherein said transport means includes a pneumatic swivel having rotating and stationary portions, wherein a plurality of conduits extend from a remote operator controller and couple to porting at said stationary portion, and including a clamp means for detachably retaining said transport means to said framework and further including a brake means mounted to said reel for controlling rotation of said reel, whereby said operator controller directs air to operate said first and second motors and brake means.

22. Apparatus for cleaning residue from a bore of a tube, comprising:

a) a hose having a spray tip containing a plurality of orifices;

b) a water source coupled to said hose and capable of delivering water to said hose at a pressure in excess of 1,000 psi;

c) a framework supporting i) transport means having a first motor and including a plurality of pinch wheels mounted to contact and direct said hose along a longitudinal drive axis, ii) reel means having a storage space transversely oriented to said longitudinal drive axis for layering said hose into coils concentric to said longitudinal drive axis and distributing said hose along said longitudinal drive axis, and iii) a second motor for rotating said transport means as said hose is collected and dispensed from said reel and as said reel passively follows rotation of said transport means; and d) an operator controller coupled to said framework and having a bore through which said hose is directed and control means for directing movement of said pinch wheels and a reciprocating axial movement of said hose in synchrony with a rotational movement of said hose.

23. Apparatus as set forth in claim 22 wherein said transport means includes an arm having a bore through which said hose is directed for directing said hose onto said reel.

24. Apparatus as set forth in claim 22 wherein said plurality of pinch wheels are mounted to a support frame having an eccentric linkage coupled to said support frame to pivot a pivoting one of said pinch wheels relative to a stationary pinch wheel between a first condition where at the pivoting and stationary pinch wheels are released from contact with said hose and a second condition where at the pivoting and stationary pinch wheels grip said hose and a tensioner for independently controlling the contact force of said pinch wheels with said hose, such that the tension is unaffected in either of said first and second conditions.

25. Apparatus as set forth in claim 22 including a disk brake coupled to said reel for controlling the speed of rotation of said reel relative to said transport means to prevent hose spillage and hose kinking.

26. Apparatus as set forth in claim 22 wherein said operator controller comprises an operator gun, and wherein said transport means includes an air swivel for coupling control air signals between said operator gun and said framework to control the rotation of said transport means and axial movement of said hose at said transport means relative to said reel means.

27. Apparatus as set forth in claim 22 wherein said transport means and said reel means are supported from and secured to bearing surfaces at said framework with clamped bearings.

28. Apparatus for cleaning residue from a bore of a tube, comprising:

a) a hose having a spray tip containing a plurality of orifices;

b) a water source coupled to said hose and capable of delivering water to said hose at a pressure in excess of 1,000 psi;

c) a framework supporting i) a reel having a hose storage space, ii) transport means having a first motor and an air swivel and a plurality of pinch wheels mounted to contact said outer wall and direct said hose along a longitudinal drive axis and an arm for concentrically layering said hose into coils at said storage space about said longitudinal drive axis, and iii) means for rotating said transport means as said hose is collected and dispensed from said reel and as said reel passively follows rotation of said transport means; and d) an operator controller coupled to said framework and having a bore through which said hose is directed and control means for directing movement of said pinch wheels and a reciprocating axial movement of said hose in synchrony with a rotational movement of said hose.

29. Apparatus as set forth in claim 28 wherein said plurality of pinch wheels are mounted to a support frame, wherein an eccentric linkage coupled to said support frame to pivot a pivoting one of said pinch wheels relative to a stationary pinch wheel between a first condition where at the pivoting and stationary pinch wheels are released from contact with said hose and a second condition where at the pivoting and stationary pinch wheels grip said hose and wherein said transport assembly includes a tensioner for independently controlling the contact force of said pinch wheels with said hose, such that the tension is unaffected in either of said first and second conditions.

30. Apparatus as set forth in claim 28 wherein said air swivel has rotating and stationary portions, wherein a plurality of conduits extend from a remote operator controller and couple to porting at said stationary portion, and including a brake means mounted to said reel for controlling rotation of said reel, whereby said operator controller directs a control media to operate said first motor said transport rotation means and said brake means.

31. Apparatus as set forth in claim 28 wherein said transport means and said reel are supported from and secured to bearing surfaces at said framework with clamped bearings.

32. Apparatus as set forth in claim 28 including a disk brake mounted to said reel and a caliper mounted to said framework and means for controlling said caliper and the rotation of said reel to prevent hose spillage and hose kinking.

33. Apparatus as set forth in claim 28 wherein said reel includes a hub mounted concentric to said longitudinal drive axis, a plurality of webs radially projecting from said hub in parallel alignment to said longitudinal drive axis, an endless shroud mounted to said webs in concentric relation to said longitudinal drive axis, and a second shroud displaced from said first shroud to define said storage space therebetween, and wherein said transport means includes a tubular member having a bore through which said hose extends and mounted to direct said hose to and from said storage space.

34. Apparatus as set forth in claim 28 wherein said transport means is detachably clamped to said framework at said air swivel and is removable as a unit.

35. Apparatus for cleaning residue from a bore of a tube, comprising:

a) a hose having a spray tip containing a plurality of orifices;

b) a water source coupled to said hose and capable of delivering water to said hose at a pressure in excess of 1,000 psi; and c) a framework supporting i) transport means engaging the outer wall of said hose and having a first motor for extending and retracting said hose with a reciprocating motion, ii) a reel having a hose storage space concentrically aligned to a longitudinal drive axis common to each of said transport means and said reel and where at said hose is layered into coils concentrically aligned to said longitudinal drive axis, and iii) a second for rotating said transport means and said reel in synchrony with each other as said hose is collected and distributed, whereby said hose and spray tip are rotated as said hose is collected and dispensed from said reel and as said reel passively follows rotation of said transport means.

* * * * *

UNITED STATES PATENT AND TRADEMARK OFFICE

CERTIFICATE OF CORRECTION

PATENT NO. : 7,178,534 B2
APPLICATION NO. : 10/673748
DATED : February 20, 2007
INVENTOR(S) : Daniel T. Garman et al.

It is certified that error appears in the above-identified patent and that said Letters Patent is hereby corrected as shown below:

Column 16, line 59, “where at” should read -- whereat --

Column 16, line 61, “where at” should read -- whereat --

Column 17, line 17, “where at” should read -- whereat --

Column 17, line 19, “where at” should read -- whereat --

Column 18, line 11, “where at” should read -- whereat --

Column 18, line 13, “where at” should read -- whereat --

Column 18, line 60, “where at” should read -- whereat --

Column 18, line 62, “where at” should read -- whereat --

Signed and Sealed this

First Day of May, 2007

JON W. DUDAS
*Director of the United States Patent and Trademark Office*